US009747920B2

(12) United States Patent
Ayrapetian et al.

(10) Patent No.: US 9,747,920 B2
(45) Date of Patent: Aug. 29, 2017

(54) ADAPTIVE BEAMFORMING TO CREATE REFERENCE CHANNELS

(71) Applicant: Amazon Technologies, Inc., Seattle, WA (US)

(72) Inventors: Robert Ayrapetian, Morgan Hills, CA (US); Philip Ryan Hilmes, San Jose, CA (US)

(73) Assignee: AMAZON TECHNOLOGIES, INC., Seattle, WA (US)

( * ) Notice: Subject to any disclaimer, the term of this patent is extended or adjusted under 35 U.S.C. 154(b) by 118 days.

(21) Appl. No.: 14/973,274

(22) Filed: Dec. 17, 2015

(65) Prior Publication Data

US 2017/0178662 A1 Jun. 22, 2017

(51) Int. Cl.

*G10L 21/0216* (2013.01)
*H04R 5/04* (2006.01)
*G10L 21/0208* (2013.01)

(52) U.S. Cl.

CPC ..... *G10L 21/0216* (2013.01); *H04R 5/04* (2013.01); *G10L 2021/02082* (2013.01); *G10L 2021/02166* (2013.01); *H04R 2203/12* (2013.01)

(58) Field of Classification Search

None

See application file for complete search history.

(56) References Cited

U.S. PATENT DOCUMENTS

2002/0193130 A1 12/2002 Yang et al.
2003/0097257 A1* 5/2003 Amada ..... G10L 21/0208 704/208
2009/0055170 A1* 2/2009 Nagahama ..... G10L 15/20 704/226
2011/0222372 A1 9/2011 O'Donovan et al.
2012/0065973 A1* 3/2012 Cho ..... G10L 21/00 704/246
2012/0163624 A1 6/2012 Hyun (Continued)

FOREIGN PATENT DOCUMENTS

WO 03013185 A1 2/2003

OTHER PUBLICATIONS

International Search Report, Mailed Feb. 17, 2017, Applicant: Amazon Technologies, Inc., 13 pages.

*Primary Examiner* — Paul Huber

(74) *Attorney, Agent, or Firm* — Pierce Atwood LLP

(57) ABSTRACT

An echo cancellation system that performs audio beamforming to separate audio input into multiple directions and determines a target signal and a reference signal from the multiple directions. For example, the system may detect a strong signal associated with a speaker and select the strong signal as a reference signal, selecting another direction as a target signal. The system may determine a speech position and may select the speech position as a target signal and an opposite direction as a reference signal. The system may create pairwise combinations of opposite directions, with an individual direction being selected as a target signal and a reference signal. The system may select a fixed beamformer output for the target signal and an adaptive beamformer output for the reference signal, or vice versa. The system may remove the reference signal (e.g., audio output by the loudspeaker) to isolate speech included in the target signal.

20 Claims, 15 Drawing Sheets

(56) References Cited

U.S. PATENT DOCUMENTS

| | | | | |
|---|---|---|---|---|
| 2013/0083832 | A1* | 4/2013 | Sorensen | G01S 3/805 375/224 |
| 2014/0025374 | A1* | 1/2014 | Lou | G10L 21/0216 704/203 |
| 2014/0126746 | A1 | 5/2014 | Shin et al. | |

* cited by examiner

ADAPTIVE BEAMFORMING TO CREATE REFERENCE CHANNELS

BACKGROUND

In audio systems, automatic echo cancellation (AEC) refers to techniques that are used to recognize when a system has recaptured sound via a microphone after some delay that the system previously output via a speaker. Systems that provide AEC subtract a delayed version of the original audio signal from the captured audio, producing a version of the captured audio that ideally eliminates the "echo" of the original audio signal, leaving only new audio information. For example, if someone were singing karaoke into a microphone while prerecorded music is output by a loudspeaker, AEC can be used to remove any of the recorded music from the audio captured by the microphone, allowing the singer's voice to be amplified and output without also reproducing a delayed "echo" the original music. As another example, a media player that accepts voice commands via a microphone can use AEC to remove reproduced sounds corresponding to output media that are captured by the microphone, making it easier to process input voice commands.

BRIEF DESCRIPTION OF DRAWINGS

For a more complete understanding of the present disclosure, reference is now made to the following description taken in conjunction with the accompanying drawings.

DETAILED DESCRIPTION

Figure 1:
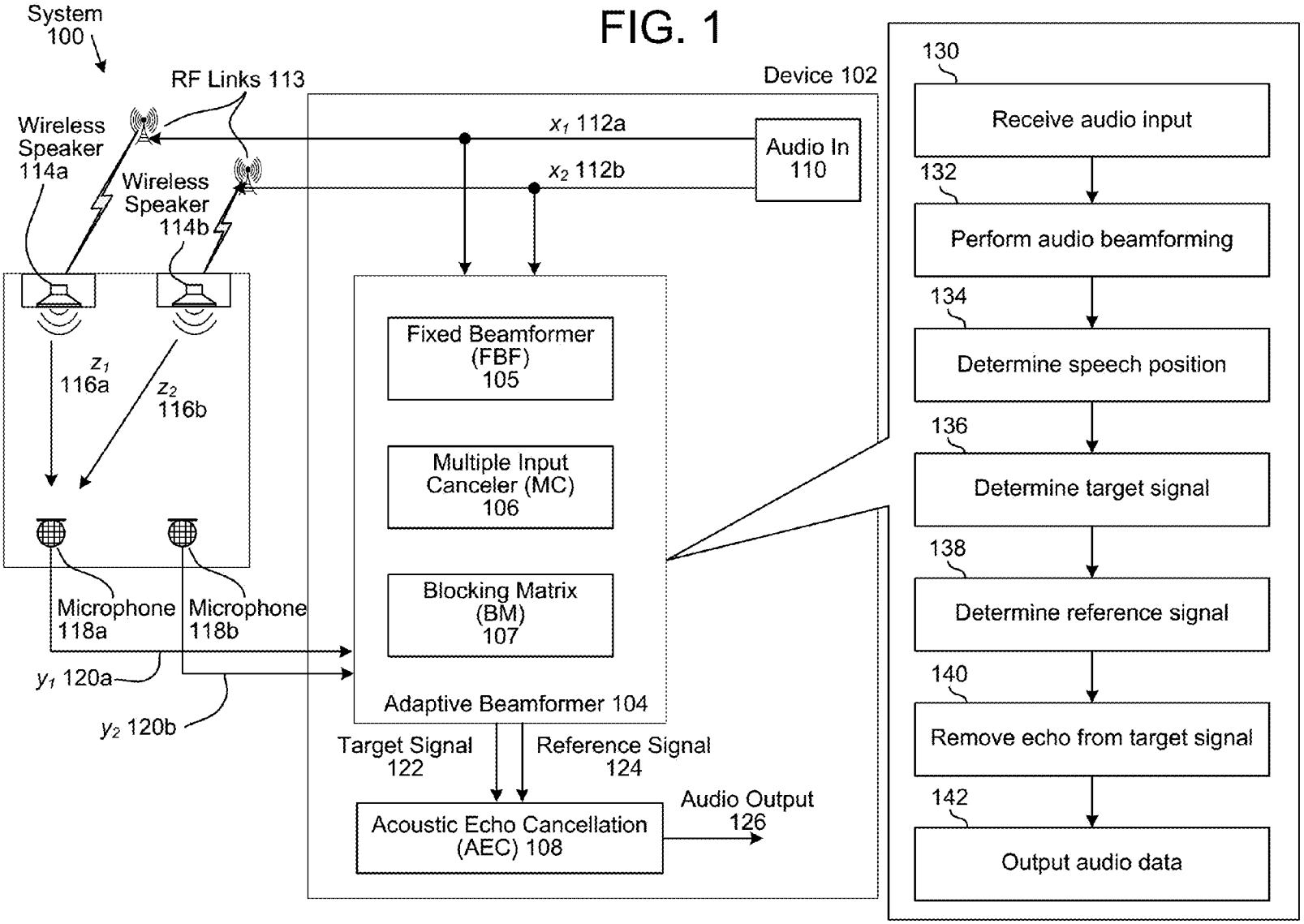
FIG. 1 illustrates an echo cancellation system that performs adaptive beamforming according to embodiments of the present disclosure.

Typically, a conventional Acoustic Echo Cancellation (AEC) system may remove audio output by a loudspeaker from audio captured by the system's microphone(s) by subtracting a delayed version of the originally transmitted audio. However, in stereo and multi-channel audio systems that include wireless or network-connected loudspeakers and/or microphones, a major cause of problems is when there are differences between the signal sent to a loudspeaker and a signal played at the loudspeaker. As the signal sent to the loudspeaker is not the same as the signal played at the loudspeaker, the signal sent to the loudspeaker is not a true reference signal for the AEC system. For example, when the AEC system attempts to remove the audio output by the loudspeaker from audio captured by the system's microphone(s) by subtracting a delayed version of the originally transmitted audio, the audio captured by the microphone is subtly different than the audio that had been sent to the loudspeaker.

There may be a difference between the signal sent to the loudspeaker and the signal played at the loudspeaker for one or more reasons. A first cause is a difference in clock synchronization (e.g., clock offset) between loudspeakers and microphones. For example, in a wireless "surround sound" 5.1 system comprising six wireless loudspeakers that each receive an audio signal from a surround-sound receiver, the receiver and each loudspeaker has its own crystal oscillator which provides the respective component with an independent "clock" signal. Among other things that the clock signals are used for is converting analog audio signals into digital audio signals ("A/D conversion") and converting digital audio signals into analog audio signals ("D/A conversion"). Such conversions are commonplace in audio systems, such as when a surround-sound receiver performs A/D conversion prior to transmitting audio to a wireless loudspeaker, and when the loudspeaker performs D/A conversion on the received signal to recreate an analog signal. The loudspeaker produces audible sound by driving a "voice coil" with an amplified version of the analog signal.

A second cause is that the signal sent to the loudspeaker may be modified based on compression/decompression during wireless communication, resulting in a different signal being received by the loudspeaker than was sent to the loudspeaker. A third case is non-linear post-processing performed on the received signal by the loudspeaker prior to playing the received signal. A fourth cause is buffering performed by the loudspeaker, which could create unknown latency, additional samples, fewer samples or the like that subtly change the signal played by the loudspeaker.

To perform Acoustic Echo Cancellation (AEC) without knowing the signal played by the loudspeaker, devices, systems and methods may perform audio beamforming on a signal received by the microphones and may determine a reference signal and a target signal based on the audio beamforming. For example, the system may receive audio input and separate the audio input into multiple directions. The system may detect a strong signal associated with a speaker and may set the strong signal as a reference signal, selecting another direction as a target signal. In some examples, the system may determine a speech position (e.g., near end talk position) and may set the direction associated with the speech position as a target signal and an opposite direction as a reference signal. If the system cannot detect a strong signal or determine a speech position, the system may create pairwise combinations of opposite directions, with an individual direction being used as a target signal and a reference signal. The system may remove the reference signal (e.g., audio output by the loudspeaker) to isolate speech included in the target signal.

FIG. 1 illustrates a high-level conceptual block diagram of echo-cancellation aspects of an AEC system 100. As illustrated, an audio input 110 provides stereo audio "reference" signals $x_1(n)$ 112*a* and $x_2(n)$ 112*b*. The reference signal $x_1(n)$ 112*a* is transmitted via a radio frequency (RF) link 113 to a wireless loudspeaker 114*a*, and the reference signal $x_2(n)$ 112*b* is transmitted via an RF link 113 to a wireless loudspeaker 114*b*. Each speaker outputs the received audio, and portions of the output sounds are captured by a pair of microphones 118*a* and 118*b* as "echo" signals $y_i(n)$ 120*a* and $y_2(n)$ 120*b*, which contain some of the reproduced sounds from the reference signals $x_1(n)$ 112*a* and $x_2(n)$ 112*b*, in addition to any additional sounds (e.g., speech) picked up by the microphones 118.

To isolate the additional sounds from the reproduced sounds, the device 102 may include an adaptive beamformer 104 that may perform audio beamforming on the echo signals 120 to determine a target signal 122 and a reference signal 124. For example, the adaptive beamformer 104 may include a fixed beamformer (FBF) 105, a multiple input canceler (MC) 106 and/or a blocking matrix (BM) 107. The FBF 105 may be configured to form a beam in a specific direction so that a target signal is passed and all other signals are attenuated, enabling the adaptive beamformer 104 to select a particular direction. In contrast, the BM 107 may be configured to form a null in a specific direction so that the target signal is attenuated and all other signals are passed. The adaptive beamformer 104 may generate fixed beamforms (e.g., outputs of the FBF 105) or may generate adaptive beamforms using a Linearly Constrained Minimum Variance (LCMV) beamformer, a Minimum Variance Distortionless Response (MVDR) beamformer or other beamforming techniques. For example, the adaptive beamformer 104 may receive audio input, determine six beamforming directions and output six fixed beamform outputs and six adaptive beamform outputs. In some examples, the adaptive beamformer 104 may generate six fixed beamform outputs, six LCMV beamform outputs and six MVDR beamform outputs, although the disclosure is not limited thereto. Using the adaptive beamformer 104 and techniques discussed below, the device 102 may determine the target signal 122 and the reference signal 124 to pass to an acoustic echo cancellation (AEC) 108. The AEC 108 may remove the reference signal (e.g., reproduced sounds) from the target signal (e.g., reproduced sounds and additional sounds) to remove the reproduced sounds and isolate the additional sounds (e.g., speech) as audio output 126.

To illustrate, in some examples the device 102 may use outputs of the FBF 105 as the target signal 122. For example, the outputs of the FBF 105 may be shown in equation (1):

$$\text{Target}=s+z+\text{noise} \tag{1}$$

where s is speech (e.g., the additional sounds), z is an echo from the signal sent to the loudspeaker (e.g., the reproduced sounds) and noise is additional noise that is not associated with the speech or the echo. In order to attenuate the echo (z), the device 102 may use outputs of the BM 107 as the reference signal 124, which may be shown in equation 2:

$$\text{Reference}=z+\text{noise} \tag{2}$$

By removing the reference signal 124 from the target signal 122, the device 102 may remove the echo and generate the audio output 126 including only the speech and some noise. The device 102 may use the audio output 126 to perform speech recognition processing on the speech to determine a command and may execute the command. For example, the device 102 may determine that the speech corresponds to a command to play music and the device 102 may play music in response to receiving the speech.

In some examples, the device 102 may associate specific directions with the reproduced sounds and/or speech based on features of the signal sent to the loudspeaker. Examples of features includes power spectrum density, peak levels, pause intervals or the like that may be used to identify the signal sent to the loudspeaker and/or propagation delay between different signals. For example, the adaptive beamformer 104 may compare the signal sent to the loudspeaker with a signal associated with a first direction to determine if the signal associated with the first direction includes reproduced sounds from the loudspeaker. When the signal associated with the first direction matches the signal sent to the loudspeaker, the device 102 may associate the first direction with a wireless speaker. When the signal associated with the first direction does not match the signal sent to the loudspeaker, the device 102 may associate the first direction with speech, a speech position, a person or the like.

As illustrated in FIG. 1, the device 102 may receive (130) an audio input and may perform (132) audio beamforming. For example, the device 102 may receive the audio input from the microphones 118 and may perform audio beamforming to separate the audio input into separate directions. The device 102 may determine (134) a speech position (e.g., near end talk position) associated with speech and/or a person speaking. For example, the device 102 may identify the speech, a person and/or a position associated with the speech/person using audio data (e.g., audio beamforming when speech is recognized), video data (e.g., facial recognition) and/or other inputs known to one of skill in the art. The device 102 may determine (136) a target signal and may determine (138) a reference signal based on the speech position and the audio beamforming. For example, the device 102 may associate the speech position with the target signal and may select an opposite direction as the reference signal.

The device 102 may determine the target signal and the reference signal using multiple techniques, which are discussed in greater detail below. For example, the device 102 may use a first technique when the device 102 detects a clearly defined speaker signal, a second technique when the device 102 doesn't detect a clearly defined speaker signal but does identify a speech position and/or a third technique when the device 102 doesn't detect a clearly defined speaker signal or a speech position. Using the first technique, the device 102 may associate the clearly defined speaker signal with the reference signal and may select any or all of the other directions as the target signal. For example, the device 102 may generate a single target signal using all of the remaining directions for a single loudspeaker or may generate multiple target signals using portions of remaining directions for multiple loudspeakers. Using the second technique, the device 102 may associate the speech position with the target signal and may select an opposite direction as the reference signal. Using the third technique, the device 102 may select multiple combinations of opposing directions to generate multiple target signals and multiple reference signals.

The device 102 may remove (140) an echo from the target signal by removing the reference signal to isolate speech or additional sounds and may output (142) audio data including the speech or additional sounds. For example, the device 102 may remove music (e.g., reproduced sounds) played over the loudspeakers 114 to isolate a voice command input to the microphones 118.

The device 102 may include a microphone array having multiple microphones 118 that are laterally spaced from each other so that they can be used by audio beamforming components to produce directional audio signals. The microphones 118 may, in some instances, be dispersed around a perimeter of the device 102 in order to apply beampatterns to audio signals based on sound captured by the microphone(s) 118. For example, the microphones 118 may be positioned at spaced intervals along a perimeter of the device 102, although the present disclosure is not limited thereto. In some examples, the microphone(s) 118 may be spacedon a substantially vertical surface of the device 102 and/or a top surface of the device 102. Each of the microphones 118 is omnidirectional, and beamforming technology is used to produce directional audio signals based on signals from the microphones 118. In other embodiments, the microphones may have directional audio reception, which may remove the need for subsequent beamforming.

In various embodiments, the microphone array may include greater or less than the number of microphones 118 shown. Speaker(s) (not illustrated) may be located at the bottom of the device 102, and may be configured to emit sound omnidirectionally, in a 360 degree pattern around the device 102. For example, the speaker(s) may comprise a round speaker element directed downwardly in the lower part of the device 102.

Using the plurality of microphones 118 the device 102 may employ beamforming techniques to isolate desired sounds for purposes of converting those sounds into audio signals for speech processing by the system. Beamforming is the process of applying a set of beamformer coefficients to audio signal data to create beampatterns, or effective directions of gain or attenuation. In some implementations, these volumes may be considered to result from constructive and destructive interference between signals from individual microphones in a microphone array.

The device 102 may include an adaptive beamformer 104 that may include one or more audio beamformers or beamforming components that are configured to generate an audio signal that is focused in a direction from which user speech has been detected. More specifically, the beamforming components may be responsive to spatially separated microphone elements of the microphone array to produce directional audio signals that emphasize sounds originating from different directions relative to the device 102, and to select and output one of the audio signals that is most likely to contain user speech.

Audio beamforming, also referred to as audio array processing, uses a microphone array having multiple microphones that are spaced from each other at known distances. Sound originating from a source is received by each of the microphones. However, because each microphone is potentially at a different distance from the sound source, a propagating sound wave arrives at each of the microphones at slightly different times. This difference in arrival time results in phase differences between audio signals produced by the microphones. The phase differences can be exploited to enhance sounds originating from chosen directions relative to the microphone array.

Beamforming uses signal processing techniques to combine signals from the different microphones so that sound signals originating from a particular direction are emphasized while sound signals from other directions are deemphasized. More specifically, signals from the different microphones are combined in such a way that signals from a particular direction experience constructive interference, while signals from other directions experience destructive interference. The parameters used in beamforming may be varied to dynamically select different directions, even when using a fixed-configuration microphone array.

A given beampattern may be used to selectively gather signals from a particular spatial location where a signal source is present. The selected beampattern may be configured to provide gain or attenuation for the signal source. For example, the beampattern may be focused on a particular user's head allowing for the recovery of the user's speech while attenuating noise from an operating air conditioner that is across the room and in a different direction than the user relative to a device that captures the audio signals.

Such spatial selectivity by using beamforming allows for the rejection or attenuation of undesired signals outside of the beampattern. The increased selectivity of the beampattern improves signal-to-noise ratio for the audio signal. By improving the signal-to-noise ratio, the accuracy of speaker recognition performed on the audio signal is improved.

The processed data from the beamformer module may then undergo additional filtering or be used directly by other modules. For example, a filter may be applied to processed data which is acquiring speech from a user to remove residual audio noise from a machine running in the environment.

Figure 2:
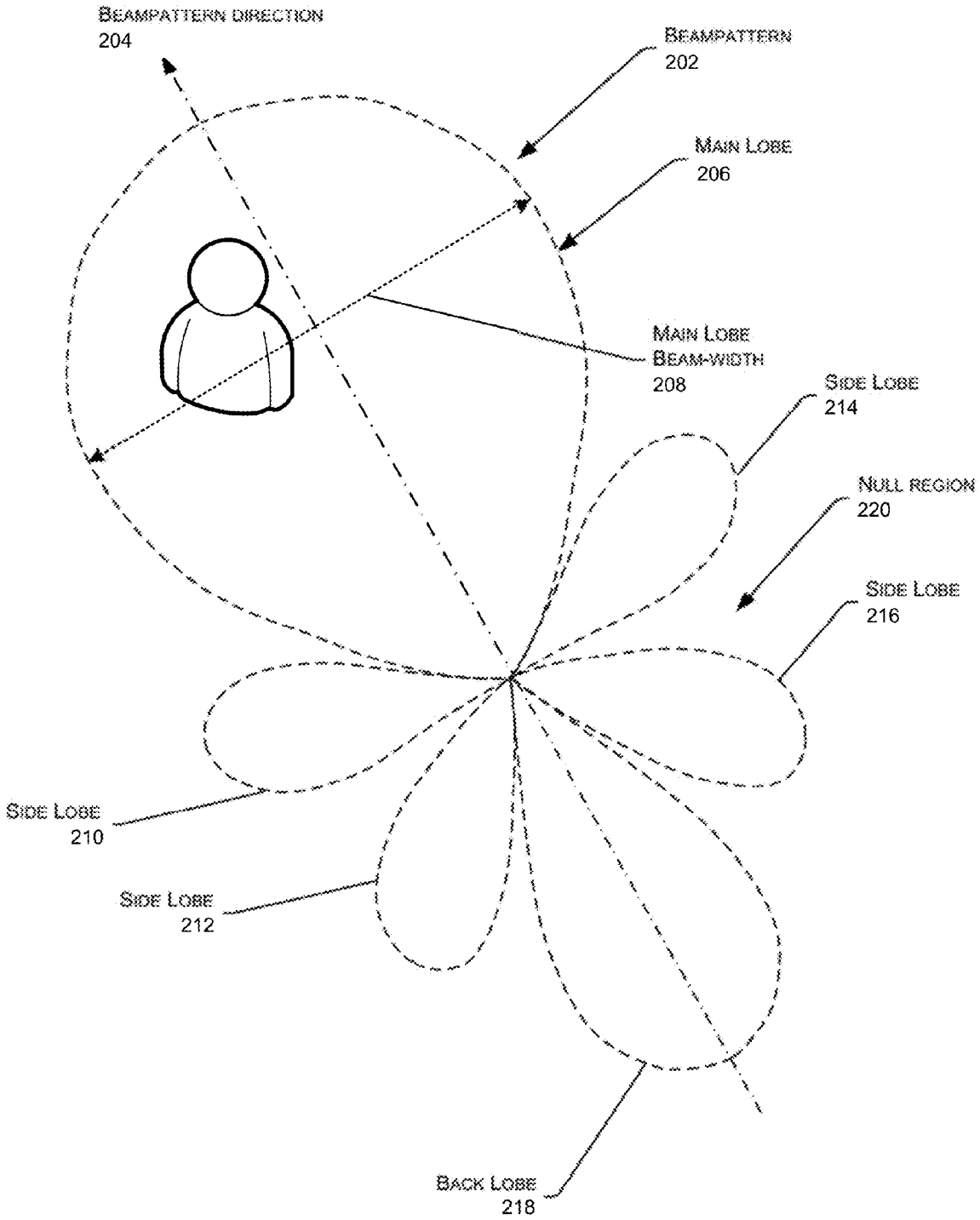
FIG. 2 is an illustration of beamforming according to embodiments of the present disclosure.

FIG. 2 is an illustration of beamforming according to embodiments of the present disclosure. FIG. 2 illustrates a schematic of a beampattern 202 formed by applying beamforming coefficients to signal data acquired from a microphone array of the device 102. As mentioned above, the beampattern 202 results from the application of a set of beamformer coefficients to the signal data. The beampattern generates directions of effective gain or attenuation. In this illustration, the dashed line indicates isometric lines of gain provided by the beamforming coefficients. For example, the gain at the dashed line here may be +12 decibels (dB) relative to an isotropic microphone.

The beampattern 202 may exhibit a plurality of lobes, or regions of gain, with gain predominating in a particular direction designated the beampattern direction 204. A main lobe 206 is shown here extending along the beampattern direction 204. A main lobe beam-width 208 is shown, indicating a maximum width of the main lobe 206. In this example, the beampattern 202 also includes side lobes 210, 212, 214, and 216. Opposite the main lobe 206 along the beampattern direction 204 is the back lobe 218. Disposed around the beampattern 202 are null regions 220. These null regions are areas of attenuation to signals. In the example, the person 10 resides within the main lobe 206 and benefits from the gain provided by the beampattern 202 and exhibits an improved SNR ratio compared to a signal acquired with non-beamforming. In contrast, if the person 10 were to speak from a null region, the resulting audio signal may be significantly reduced. As shown in this illustration, the use of the beampattern provides for gain in signal acquisition compared to non-beamforming. Beamforming also allows for spatial selectivity, effectively allowing the system to "turn a deaf ear" on a signal which is not of interest. Beamforming may result in directional audio signal(s) that may then be processed by other components of the device 102 and/or system 100.

While beamforming alone may increase a signal-to-noise (SNR) ratio of an audio signal, combining known acoustic characteristics of an environment (e.g., a room impulse response (RIR)) and heuristic knowledge of previous beampattern lobe selection may provide an even better indication of a speaking user's likely location within the environment. In some instances, a device includes multiple microphones that capture audio signals that include user speech. As is known and as used herein, "capturing" an audio signal includes a microphone transducing audio waves of captured sound to an electrical signal and a codec digitizing the signal. The device may also include functionality for applying different beampatterns to the captured audio signals, with each beampattern having multiple lobes. By identifying lobes most likely to contain user speech using the combination discussed above, the techniques enable devotion of additional processing resources of the portion of an audio signal most likely to contain user speech to provide better echo canceling and thus a cleaner SNR ratio in the resulting processed audio signal.

To determine a value of an acoustic characteristic of an environment (e.g., an RIR of the environment), the device 102 may emit sounds at known frequencies (e.g., chirps, text-to-speech audio, music or spoken word content playback, etc.) to measure a reverberant signature of the environment to generate an RIR of the environment. Measured over time in an ongoing fashion, the device may be able to generate a consistent picture of the RIR and the reverberant qualities of the environment, thus better enabling the device to determine or approximate where it is located in relation to walls or corners of the environment (assuming the device is stationary). Further, if the device is moved, the device may be able to determine this change by noticing a change in the RIR pattern. In conjunction with this information, by tracking which lobe of a beampattern the device most often selects as having the strongest spoken signal path over time, the device may begin to notice patterns in which lobes are selected. If a certain set of lobes (or microphones) is selected, the device can heuristically determine the user's typical speaking location in the environment. The device may devote more CPU resources to digital signal processing (DSP) techniques for that lobe or set of lobes. For example, the device may run acoustic echo cancelation (AEC) at full strength across the three most commonly targeted lobes, instead of picking a single lobe to run AEC at full strength. The techniques may thus improve subsequent automatic speech recognition (ASR) and/or speaker recognition results as long as the device is not rotated or moved. And, if the device is moved, the techniques may help the device to determine this change by comparing current RIR results to historical ones to recognize differences that are significant enough to cause the device to begin processing the signal coming from all lobes approximately equally, rather than focusing only on the most commonly targeted lobes.

By focusing processing resources on a portion of an audio signal most likely to include user speech, the SNR of that portion may be increased as compared to the SNR if processing resources were spread out equally to the entire audio signal. This higher SNR for the most pertinent portion of the audio signal may increase the efficacy of the device 102 when performing speaker recognition on the resulting audio signal.

Using the beamforming and directional based techniques above, the system may determine a direction of detected audio relative to the audio capture components. Such direction information may be used to link speech / a recognized speaker identity to video data as described below.

Figure 3B:
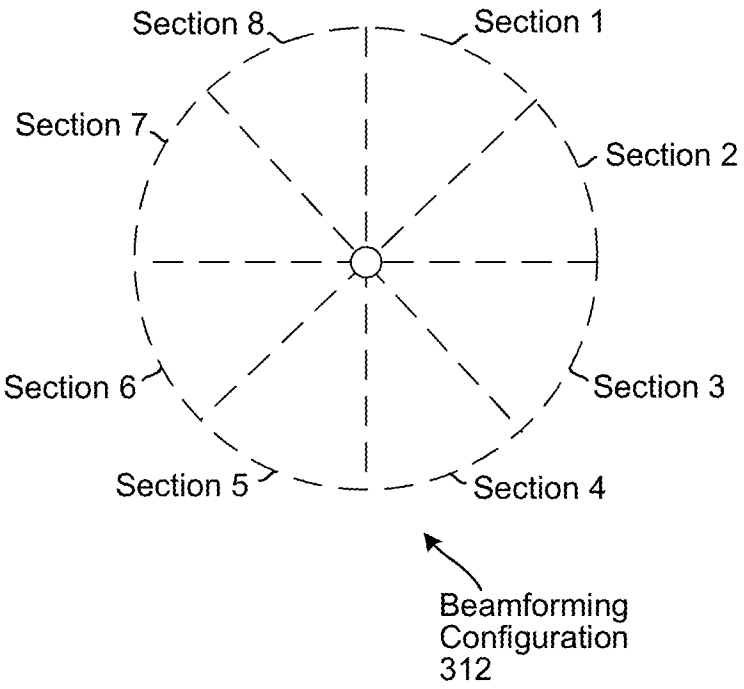
FIGS. 3A-3B illustrate examples of beamforming configurations according to embodiments of the present disclosure.
Figure 3A:
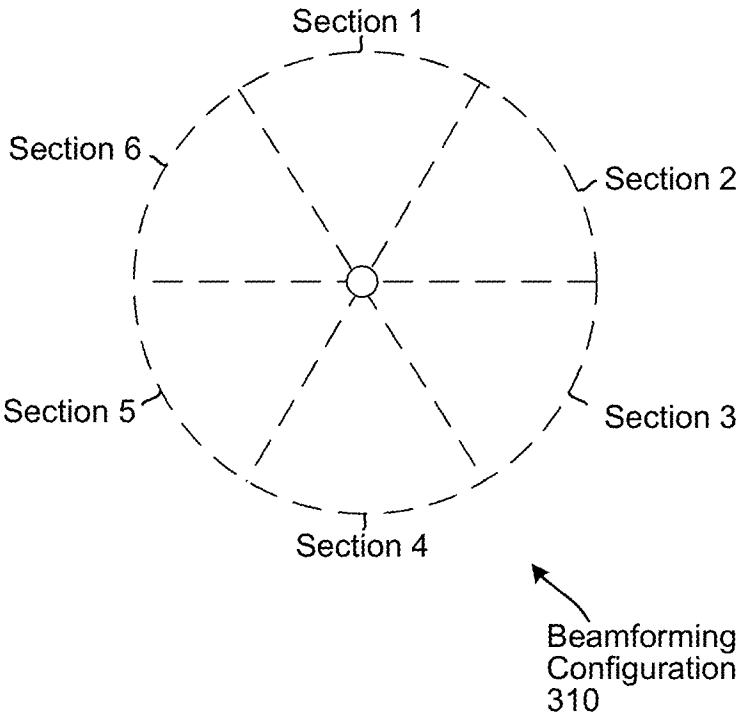

FIGS. 3A-3B illustrate examples of beamforming configurations according to embodiments of the present disclosure. As illustrated in FIG. 3A, the device 102 may perform beamforming to determine a plurality of portions or sections of audio received from a microphone array. FIG. 3A illustrates a beamforming configuration 310 including six portions or sections (e.g., Sections 1-6). For example, the device 102 may include six different microphones, may divide an area around the device 102 into six sections or the like. However, the present disclosure is not limited thereto and the number of microphones in the microphone array and/or the number of portions/sections in the beamforming may vary. As illustrated in FIG. 3B, the device 102 may generate a beamforming configuration 312 including eight portions/sections (e.g., Sections 1-8) without departing from the disclosure. For example, the device 102 may include eight different microphones, may divide the area around the device 102 into eight portions/sections or the like. Thus, the following examples may perform beamforming and separate an audio signal into eight different portions/sections, but these examples are intended as illustrative examples and the disclosure is not limited thereto.

The number of portions/sections generated using beamforming does not depend on the number of microphones in the microphone array. For example, the device 102 may include twelve microphones in the microphone array but may determine three portions, six portions or twelve portions of the audio data without departing from the disclosure. As discussed above, the adaptive beamformer 104 may generate fixed beamforms (e.g., outputs of the FBF 105) or may generate adaptive beamforms using a Linearly Constrained Minimum Variance (LCMV) beamformer, a Minimum Variance Distortionless Response (MVDR) beamformer or other beamforming techniques. For example, the adaptive beamformer 104 may receive the audio input, may determine six beamforming directions and output six fixed beamform outputs and six adaptive beamform outputs corresponding to the six beamforming directions. In some examples, the adaptive beamformer 104 may generate six fixed beamform outputs, six LCMV beamform outputs and six MVDR beamform outputs, although the disclosure is not limited thereto.

The device 102 may determine a number of wireless loudspeakers and/or directions associated with the wireless loudspeakers using the fixed beamform outputs. For example, the device 102 may localize energy in the frequency domain and clearly identify much higher energy in two directions associated with two wireless loudspeakers (e.g., a first direction associated with a first speaker and a second direction associated with a second speaker). In some examples, the device 102 may determine an existence and/or location associated with the wireless loudspeakers using a frequency range (e.g., 1 kHz to 3 kHz), although the disclosure is not limited thereto. In some examples, the device 102 may determine an existence and location of the wireless speaker(s) using the fixed beamform outputs, may select a portion of the fixed beamform outputs as the target signal(s) and may select a portion of adaptive beamform outputs corresponding to the wireless speaker(s) as the reference signal(s).

To perform echo cancellation, the device 102 may determine a target signal and a reference signal and may remove the reference signal from the target signal to generate an output signal. For example, the loudspeaker may output audible sound associated with a first direction and a person may generate speech associated with a second direction. To remove the audible sound output from the loudspeaker, the device 102 may select a first portion of audio data corresponding to the first direction as the reference signal and may select a second portion of the audio data corresponding to the second direction as the target signal. However, the disclosure is not limited to a single portion being associated with the reference signal and/or target signal and the device 102 may select multiple portions of the audio data corresponding to multiple directions as the reference signal/target signal without departing from the disclosure. For example, the device 102 may select a first portion and a second portion as the reference signal and may select a third portion and a fourth portion as the target signal.

Additionally or alternatively, the device 102 may determine more than one reference signal and/or target signal. For example, the device 102 may identify a first wireless speaker and a second wireless speaker and may determine a first reference signal associated with the first wireless speaker and determine a second reference signal associated with the second wireless speaker. The device 102 may generate a first output by removing the first reference signal from the target signal and may generate a second output by removing the second reference signal from the target signal. Similarly, the device 102 may select a first portion of the audio data as a first target signal and may select a second portion of the audio data as a second target signal. The device 102 may therefore generate a first output by removing the reference signal from the first target signal and may generate a second output by removing the reference signal from the second target signal.

The device 102 may determine reference signals, target signals and/or output signals using any combination of portions of the audio data without departing from the disclosure. For example, the device 102 may select first and second portions of the audio data as a first reference signal, may select a third portion of the audio data as a second reference signal and may select remaining portions of the audio data as a target signal. In some examples, the device 102 may include the first portion in a first reference signal and a second reference signal or may include the second portion in a first target signal and a second target signal. If the device 102 selects multiple target signals and/or reference signals, the device 102 may remove each reference signal from each of the target signals individually (e.g., remove reference signal 1 from target signal 1, remove reference signal 1 from target signal 2, remove reference signal 2 from target signal 1, etc.), may collectively remove the reference signals from each individual target signal (e.g., remove reference signals 1-2 from target signal 1, remove reference signals 1-2 from target signal 2, etc.), remove individual reference signals from the target signals collectively (e.g., remove reference signal 1 from target signals 1-2, remove reference signal 2 from target signals 1-2, etc.) or any combination thereof without departing from the disclosure.

The device 102 may select fixed beamform outputs or adaptive beamform outputs as the target signal(s) and/or the reference signal(s) without departing from the disclosure. In a first example, the device 102 may select a first fixed beamform output (e.g., first portion of the audio data determined using fixed beamforming techniques) as a reference signal and a second fixed beamform output as a target signal. In a second example, the device 102 may select a first adaptive beamfrom output (e.g., first portion of the audio data determined using adaptive beamforming techniques) as a reference signal and a second adaptive beamform output as a target signal. In a third example, the device 102 may select the first fixed beamform output as the reference signal and the second adaptive beamform output as the target signal. In a fourth example, the device 102 may select the first adaptive beamform output as the reference signal and the second fixed beamform output as the target signal. However, the disclosure is not limited thereto and further combinations thereof may be selected without departing from the disclosure.

Figure 4:
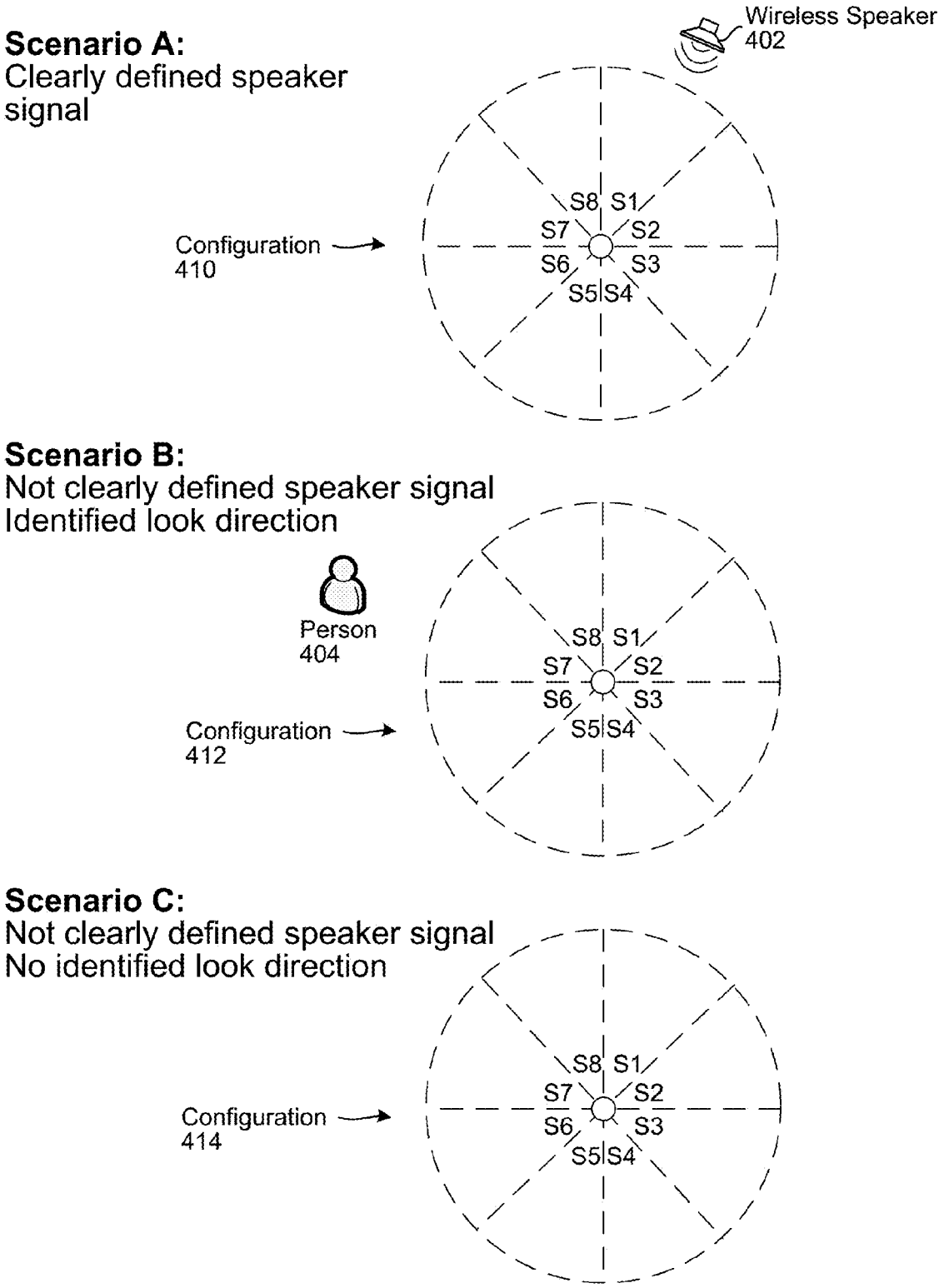
FIG. 4 illustrates an example of different techniques of adaptive beamforming according to embodiments of the present disclosure.

FIG. 4 illustrates an example of different techniques of adaptive beamforming according to embodiments of the present disclosure. As illustrated in FIG. 4, a first technique may be used with scenario A, which may occur when the device 102 detects a clearly defined speaker signal. For example, the configuration 410 includes a wireless speaker 402 and the device 102 may associate the wireless speaker 402 with a first section S1. The device 102 may identify the wireless speaker 402 and/or associate the first section S1 with a wireless speaker. As will be discussed in greater detail below, the device 102 may set the first section S1 as a reference signal and may identify one or more sections as a target signal. While the configuration 410 includes a single wireless speaker 402, the disclosure is not limited thereto and there may be multiple wireless speakers 402.

As illustrated in FIG. 4, a second technique may be used with scenario B, which occurs when the device 102 doesn't detect a clearly defined speaker signal but does identify a speech position (e.g., near end talk position) associated with person 404. For example, the device 102 may identify the person 404 and/or a position associated with the person 404 using audio data (e.g., audio beamforming), video data (e.g., facial recognition) and/or other inputs known to one of skill in the art. As illustrated in FIG. 4, the device 102 may associate the person 404 with section S7. By determining the position associated with the person 404, the device 102 may set the section (e.g., S7) as a target signal and may set one or more sections as reference signals.

As illustrated in FIG. 4, a third technique may be used with scenario C, which occurs when the device 102 doesn't detect a clearly defined speaker signal or a speech position. For example, audio from a wireless speaker may reflect off of multiple objects such that the device 102 receives the audio from multiple locations at a time and is therefore unable to locate a specific section to associate with the wireless speaker. Due to the lack of a defined speaker signal and a speech position, the device 102 may remove an echo by creating pairwise combinations of the sections. For example, as will be described in greater detail below, the device 102 may use a first section S1 as a target signal and a fifth section S5 as a reference signal in a first equation and may use the fifth section S5 as a target signal and the first section S1 as a reference signal in a second equation. The device 102 may combine each of the different sections such that there are the same number of equations (e.g., eight) as sections (e.g., eight).

Figure 5A:
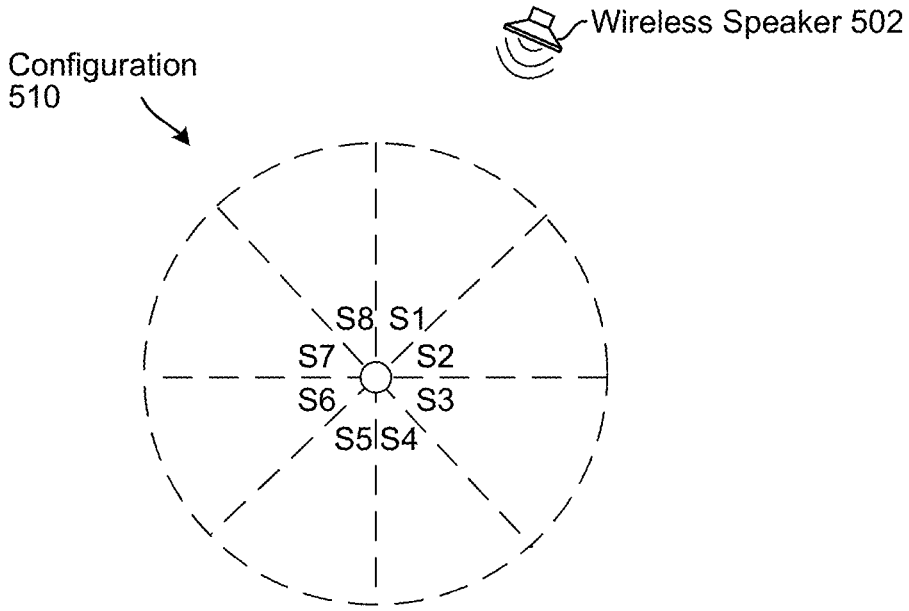
FIGS. 5A-5B illustrate examples of a first signal mapping using a first technique according to embodiments of the present disclosure.
Figure 5B:
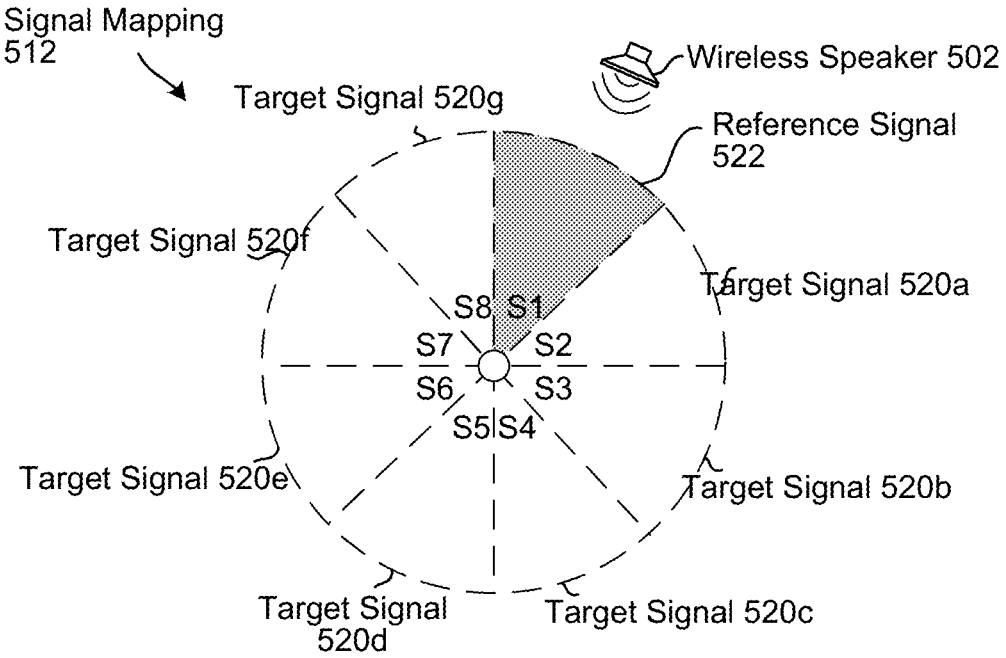

FIGS. 5A-5B illustrate examples of a first signal mapping using a first technique according to embodiments of the present disclosure. As illustrated in FIG. 5A, a configuration 510 may include a wireless speaker 502 and the device 102 may detect a clearly defined speaker signal in the first section S1 and may associate the first section S1 with the wireless speaker 502. For example, the device 102 may identify the wireless speaker 502 and/or associate the first section S1 with an unidentified wireless speaker.

After determining that there is a single wireless speaker 502 in the configuration 510, the device 102 may set the first section S1 as a reference signal 522 and may identify one or more other sections (e.g., sections S2-S8) as target signals 520*a*-520g. By removing the reference signal 522 from the target signals 520*a*-520g, the device 102 may remove an echo caused by receiving audible sound from the wireless speaker 502. Therefore, when the device 102 detects a single wireless speaker 502, the device 102 may associate the wireless speaker 502 (or the section receiving audio from the wireless speaker) with the reference signal and remove the reference signal from the other sections.

Figure 6A:
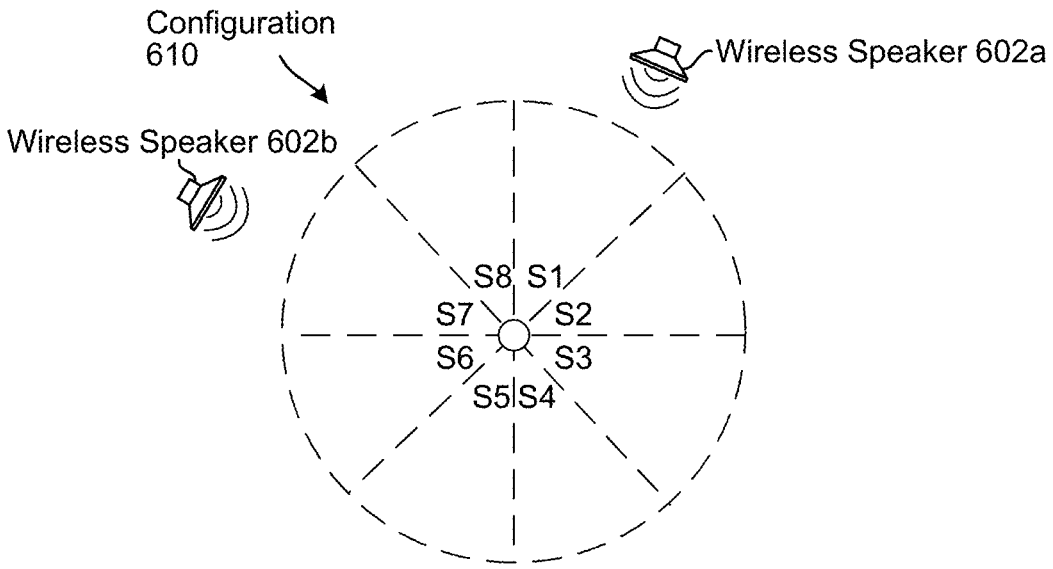
FIGS. 6A-6C illustrate examples of signal mappings using the first technique according to embodiments of the present disclosure.
Figure 6B:
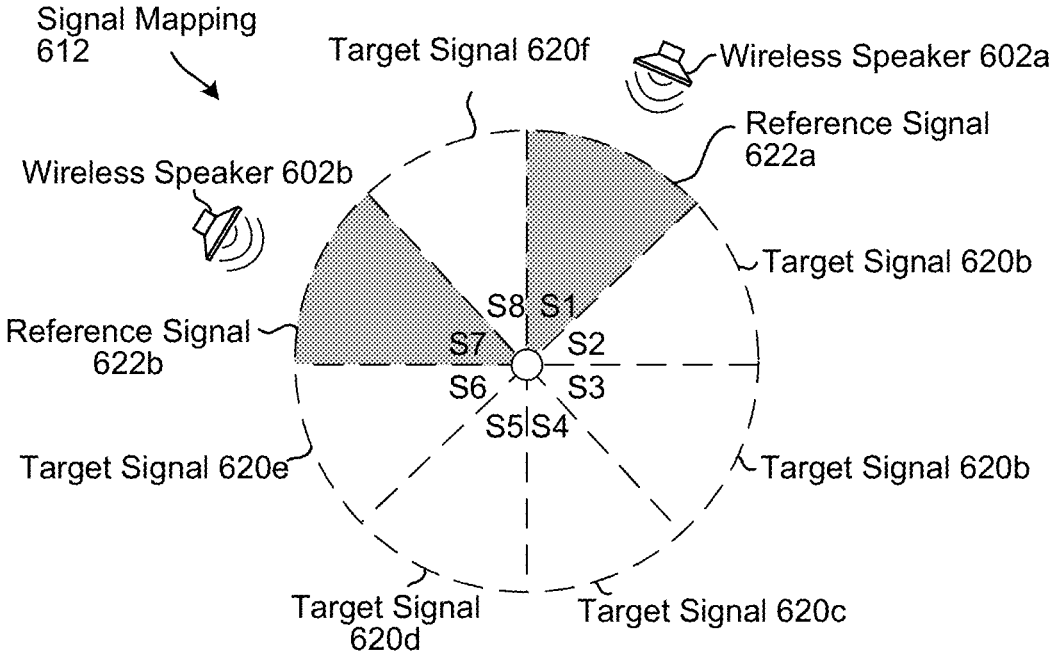
Figure 6C:
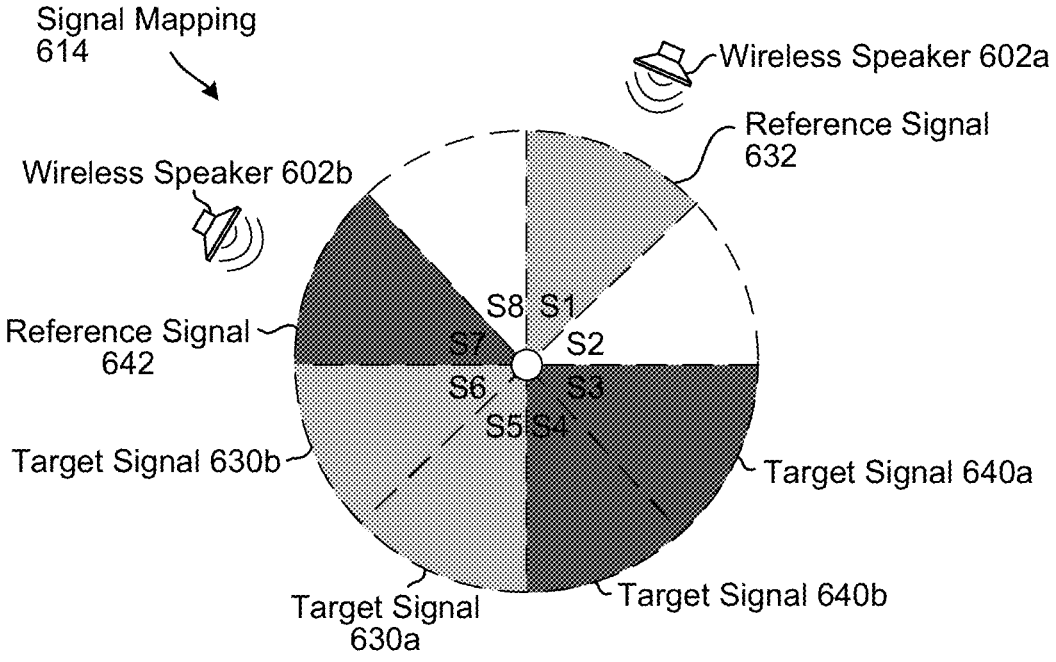

While the configuration 510 includes a single wireless speaker 502, the disclosure is not limited thereto and there may be multiple wireless speakers. FIGS. 6A-6C illustrate examples of signal mappings using the first technique according to embodiments of the present disclosure. As illustrated in FIG. 6A, a configuration 610 may include a first wireless speaker 602*a* and a second wireless speaker 602*b*. Therefore, the device 102 may detect clearly defined speaker signals from two directions and may associate respective sections (e.g., 51 and S7) with the wireless speakers 602. For example, the device 102 may identify the first wireless speaker 602*a* and the second wireless speaker 602*b* and associate the first wireless speaker 602*a* with the first section S1 and associate the second wireless speaker 602*b* with the seventh section S7. Additionally or alternatively, the device 102 may associate the first section S1 and the seventh section S7 with unidentified wireless speakers.

As illustrated in FIG. 6B, after determining that there are multiple wireless speaker 602 in the configuration 610, the device 102 may select the first section S1 as a first reference signal 622*a* and may select the seventh section S7 as a second reference signal 622*b*. The device 102 may select one or more of the remaining sections (e.g., sections S2-S6 and S8) as target signals 620*a*-620f By removing the first reference signal 622*a* and the second reference signal 622*b* from the target signals 620*a*-620f, the device 102 may remove an echo caused by receiving audible sound from the first wireless speaker 602*a* and the second wireless speaker 602*b*.

While FIG. 6B illustrates selecting sections corresponding to the first wireless speaker 602*a* and the second wireless speaker 602*b* as reference signals and selecting remaining sections as target signals, the disclosure is not limited thereto. Instead, the device 102 may associate individual target signals with individual reference signals. For example, FIG. 6C illustrates the device 102 selecting the first section S1 as a first reference signal 632 and identifying one or more other sections (e.g., sections S5-S6) as first target signals 630*a*-630*b*. By removing the first reference signal 632 from the first target signals 630*a*-630*b*, the device 102 may remove an echo caused by receiving audible sound from the first wireless speaker 602*a*. Additionally, the device 102 may select the seventh section S7 as a second reference signal 642 and may identify one or more other sections (e.g., sections S3-S4) as second target signals 640*a*-640*b*. By removing the second reference signal 642 from the second target signals 640*a*-640*b*, the device 102 may remove an echo caused by receiving audio sound from the second wireless speaker 602*b*.

As illustrated in FIG. 6C, the device 102 selects the first target signals 630*a*-620*b* to be opposite the first reference signal 632. For example, the device 102 may associate the first reference signal 632 with the first section S1 and may select a fifth section S5 for the first target signal 630*a* and a sixth section S6 for the first target signal 630*b*. However, while FIG. 6C illustrates the device 102 selecting the sixth section S6 as the second target signal 630*b*, the disclosure is not limited thereto and the device 102 may identify only fifth section S5 as the target signal 630*a* without departing from the disclosure. Therefore, when the device 102 detects multiple wireless speaker 602, the device 102 may associate a section receiving audio from the wireless speaker 602 with a reference signal, may determine one or more sections opposite the reference signal, may associate the opposite sections with a target signal and may remove the reference signal from the target signal.

While FIGS. 6A-6C illustrate two wireless speakers, the disclosure is not limited thereto and the examples illustrated in FIGS. 6A-6C may be used for one wireless speaker (e.g. mono audio), two wireless speakers (e.g., stereo audio) and/or three or more wireless speakers (e.g., 5.1 audio, 7.1 audio or the like) without departing from the disclosure.

Figure 7A:
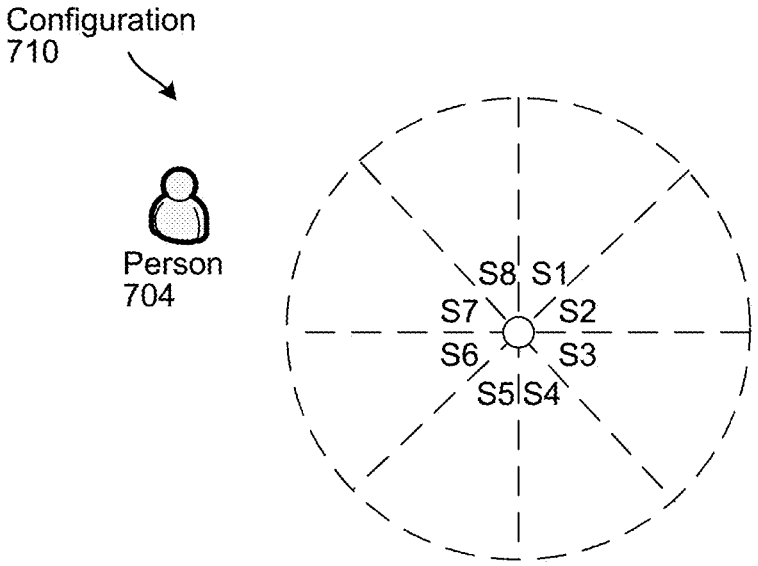
FIGS. 7A-7C illustrate examples of signal mappings using a second technique according to embodiments of the present disclosure.
Figure 7B:
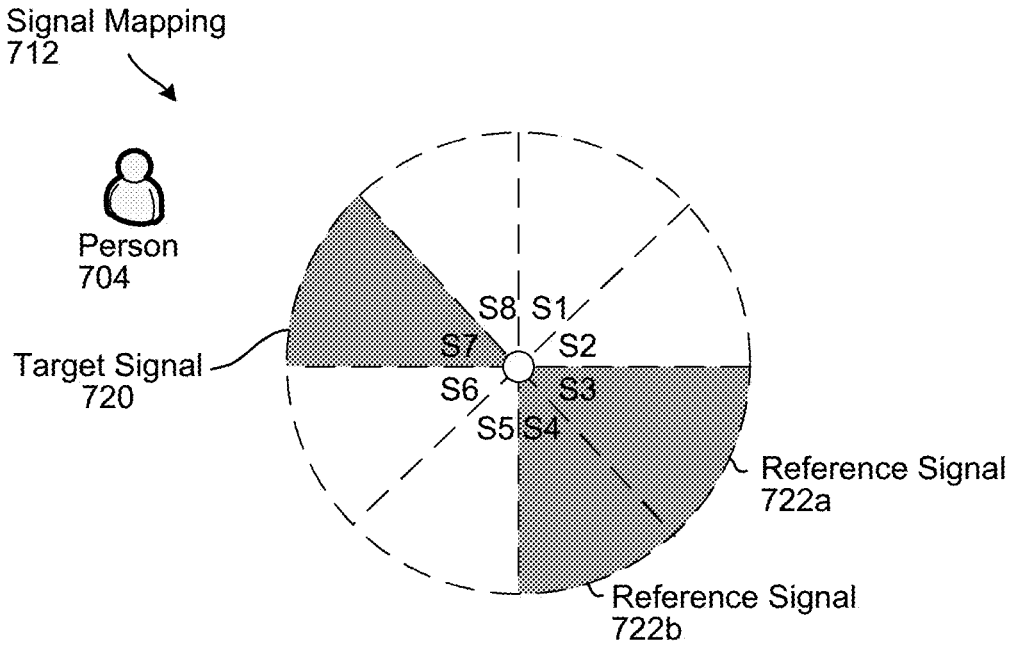
Figure 7C:
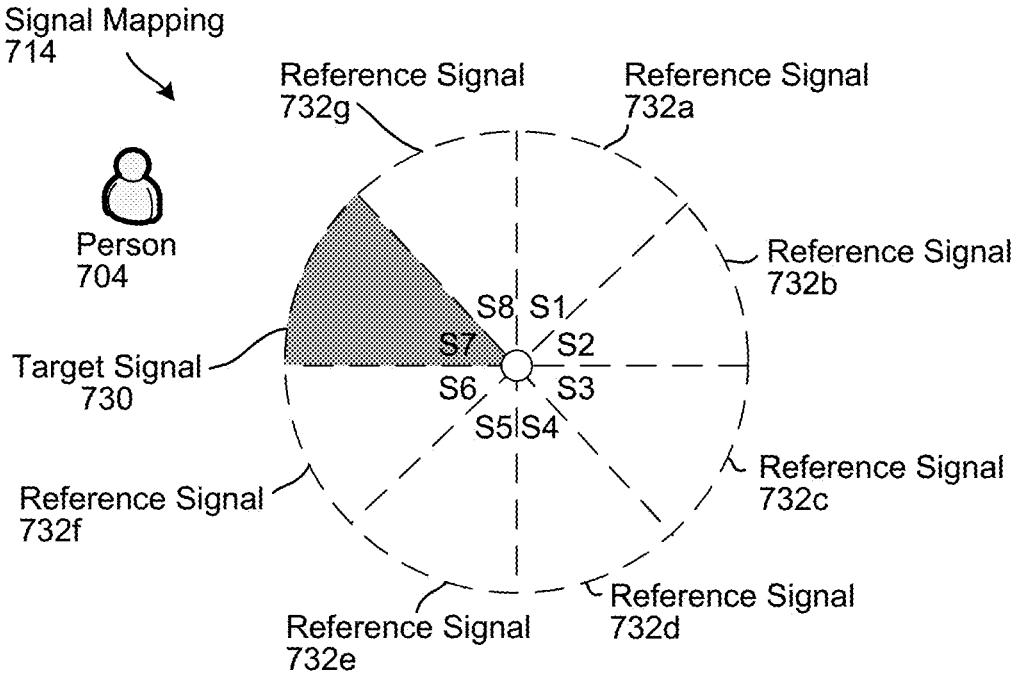

FIGS. 7A-7C illustrate examples of signal mappings using a second technique according to embodiments of the present disclosure. As illustrated in FIG. 7A, the device 102 may not detect a clearly defined speaker signal and may instead identify a speech position associated with person 704. For example, the device 102 may identify the person 704 and/or a position associated with the person 704 using audio data (e.g., audio beamforming), video data (e.g., facial recognition) and/or other inputs known to one of skill in the art. As illustrated in FIG. 7B, the device 102 may associate a section S7 with the person 704. By determining the position associated with the person 704, the device 102 may set a corresponding section (e.g., S7) as a target signal 720 and may set one or more other sections (e.g., S3-S4) as reference signals 722*a*-722*b*. For example, the device 102 may identify a speech position, may associate the seventh section S7 with the speech position and a target signal, may determine one or more sections opposite the target signal, may associate the opposite sections with a reference signal and may remove the reference signal from the target signal. In contrast to identifying the reference signal based on the wireless speaker discussed above with regard to FIGS. 5A-6C, the device 102 may instead identify the target signal 720 based on the person 704 and may remove reference signals from the target signal to isolate speech and remove an echo.

While FIG. 7B illustrates the device 102 selecting sections S3 and S4 with the reference signal 722, this is intended as an illustrative example and the disclosure is not limited thereto. In some examples, the device 102 may select the section opposite the target signal (e.g., section S3, which is opposite section S7) as the reference signal. In other examples, the device 102 may select multiple sections opposite the target signal (e.g., two or more of sections S2-S5). As illustrated in FIG. 7C, the device 102 may select all remaining sections (e.g., sections S1-S6 and S8) not included in the target signal (e.g., section S7) as reference signals. For example, the device 102 may select section S7 as a target signal 730 and may select sections S1-S6 and S8 as reference signals 732*a*-732*g*.

While not illustrated in FIGS. 7A-7C, the device 102 may determine two or more speech positions (e.g., near end talk positions) and may determine one or more target signals based on the two or more speech positions. For example, the device 102 may select multiple sections of the audio beamforming corresponding to the two or more speech positions as a single target signal, or the device 102 may select first sections of the audio beamforming corresponding to a first speech position as a first target signal and may select second sections of the audio beamforming corresponding to a second speech position as a second target signal. The device 102 may select the target signals and/or reference signals using additional combinations without departing from the present disclosure.

Figure 8A:
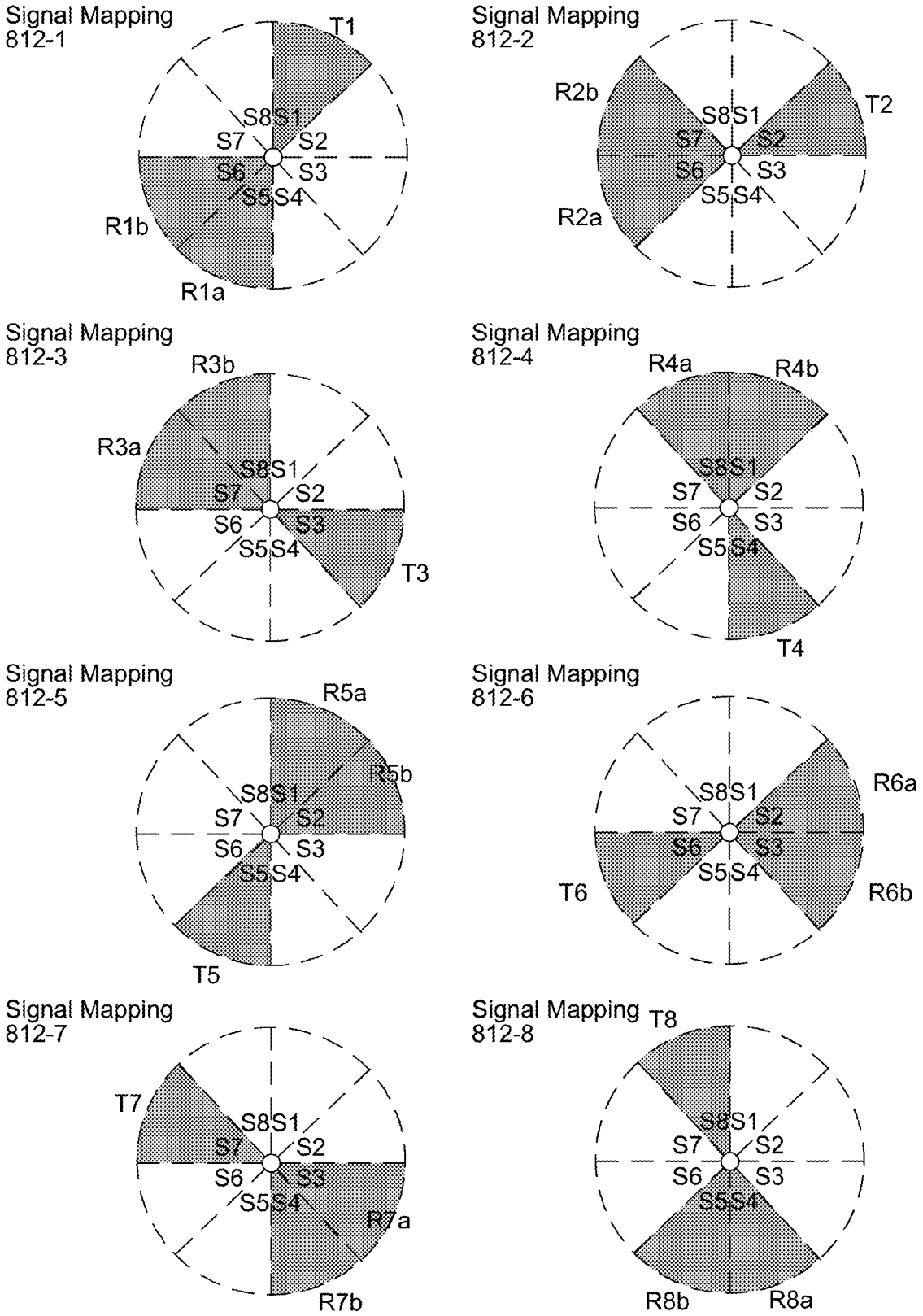
FIGS. 8A-8B illustrate examples of signal mappings using a third technique according to embodiments of the present disclosure.
Figure 8B:
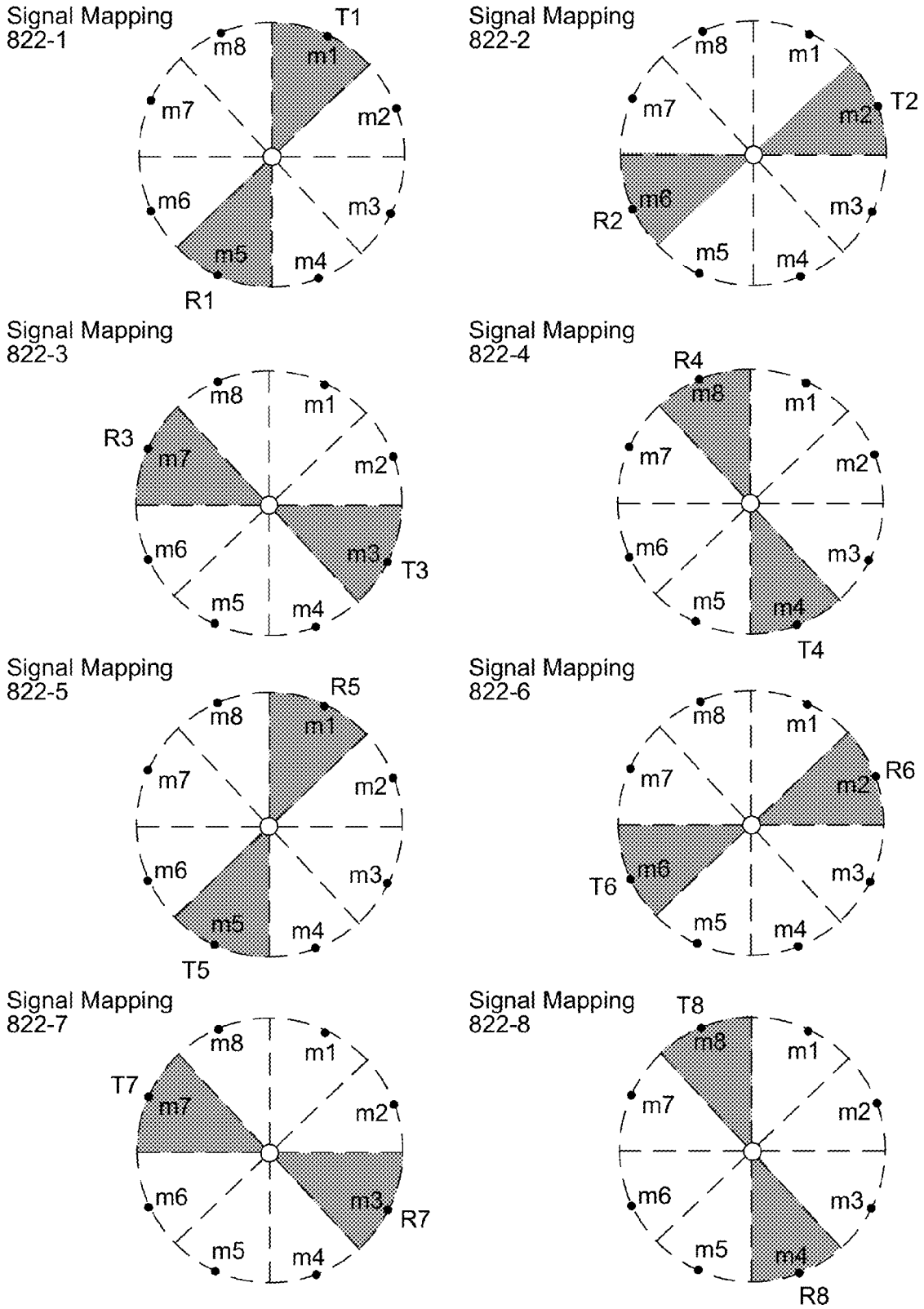

In some examples, the device 102 may not detect a clearly defined speaker signal or determine a speech position. In order to remove an echo, the device 102 may determine pairwise combinations of opposing sections. FIGS. 8A-8B illustrate examples of a signal mappings using a third technique according to embodiments of the present disclosure. As illustrated in FIG. 8A, the device 102 may not detect a clearly defined speaker signal. For example, audio from a wireless speaker may reflect off of multiple objects such that the device 102 receives the audio from multiple locations at a time and is therefore unable to locate a specific section to associate with the wireless speaker. In addition, the device 102 may not determine a speech position associated with a person. Due to the lack of a defined speaker signal and a speech position, the device 102 may create pairwise combinations of opposing sections.

As illustrated in FIG. 8A, the device 102 may generate a first signal mapping 812-1 using a first section S1 as a target signal T1 and sections S5-S6 as reference signals R1*a*-R1*b*. The device 102 may generate a second signal mapping 812-2 using a second section S2 as a target signal T2 and sections S6-S7 as reference signals R2*a*-R2*b*. The device 102 may generate a third signal mapping 812-3 using a third section S3 as a target signal T3 and sections S7-S8 as reference signals R3*a*-R3*b*. The device 102 may generate a fourth signal mapping 812-4 using a fourth section S4 as a target signal T4 and sections 58-51 as reference signals R4*a*-R4*b*. The device 102 may generate a fifth signal mapping 812-5 using the fifth section S5 as a target signal T5 and sections S1-S2 as reference signals R5*a*-R5*b*. The device 102 may generate a sixth signal mapping 812-6 using the sixth section S6 as a target signal T6 and sections S2-S3 as reference signals R6*a*-R6*b*. The device 102 may generate a seventh signal mapping 812-7 using the seventh section S7 as a target signal T7 and sections S3-S4 as reference signals R7*a*-R7*b*. Finally, the device 102 may generate an eighth signal mapping 812-8 using the eighth section S8 as a target signal T8 and sections S4-S5 as reference signals R8*a*-R8*b*.

As illustrated in FIG. 8A, each section is used as both a target signal and a reference signal, resulting in an equal number of signal mappings 812 as there are sections. The device 102 may generate an equation using each signal mapping 812-1 to 812-8 and may solve the equations to remove an echo from one or more wireless speakers.

While FIG. 8A illustrates multiple sections being used as reference signals in a single signal mapping 812, the disclosure is not limited thereto. Instead, FIG. 8B illustrates an example of a single section being used as a reference signal in a single signal mapping. In addition, FIG. 8B illustrates the individual sections as being associated with individual microphones (m1-m8). For example, in a microphone array consisting of eight microphones, the first section S1 may correspond to a first microphone m1, the second section S2 may correspond to a second microphone m2 and so on.

As illustrated in FIG. 8B, the device 102 may generate a first signal mapping 822-1 using a first microphone m1 as a target signal T1 and microphone m5 as reference signal R1. The device 102 may generate a second signal mapping 822-2 using a second microphone m2 as a target signal T2 and microphone m6 as reference signal R2. The device 102 may generate a third signal mapping 822-3 using a third microphone m3 as a target signal T3 and microphone m7 as reference signal R3. The device 102 may generate a fourth signal mapping 822-4 using a fourth microphone m4 as a target signal T4 and microphone m8 as reference signal R4. The device 102 may generate a fifth signal mapping 822-5 using the fifth microphone m5 as a target signal T5 and microphone m1 as reference signal R5. The device 102 may generate a sixth signal mapping 822-6 using the sixth microphone m6 as a target signal T6 and microphone m2 as reference signal R6. The device 102 may generate a seventh signal mapping 822-7 using the seventh microphone m7 as a target signal T7 and microphone m3 as reference signal R7. Finally, the device 102 may generate an eighth signal mapping 822-8 using the eighth microphone m8 as a target signal T8 and microphone m4 as reference signal R8.

As illustrated in FIG. 8B, the device 102 generates pairwise combinations of opposing microphones, such that each microphone is used as both a target signal and a reference signal, resulting in an equal number of signal mappings 822 as there are microphones. The device 102 may generate an equation using each signal mapping 822-1 to 822-8 and may solve the equations to remove an echo from one or more wireless speakers.

Figure 9:
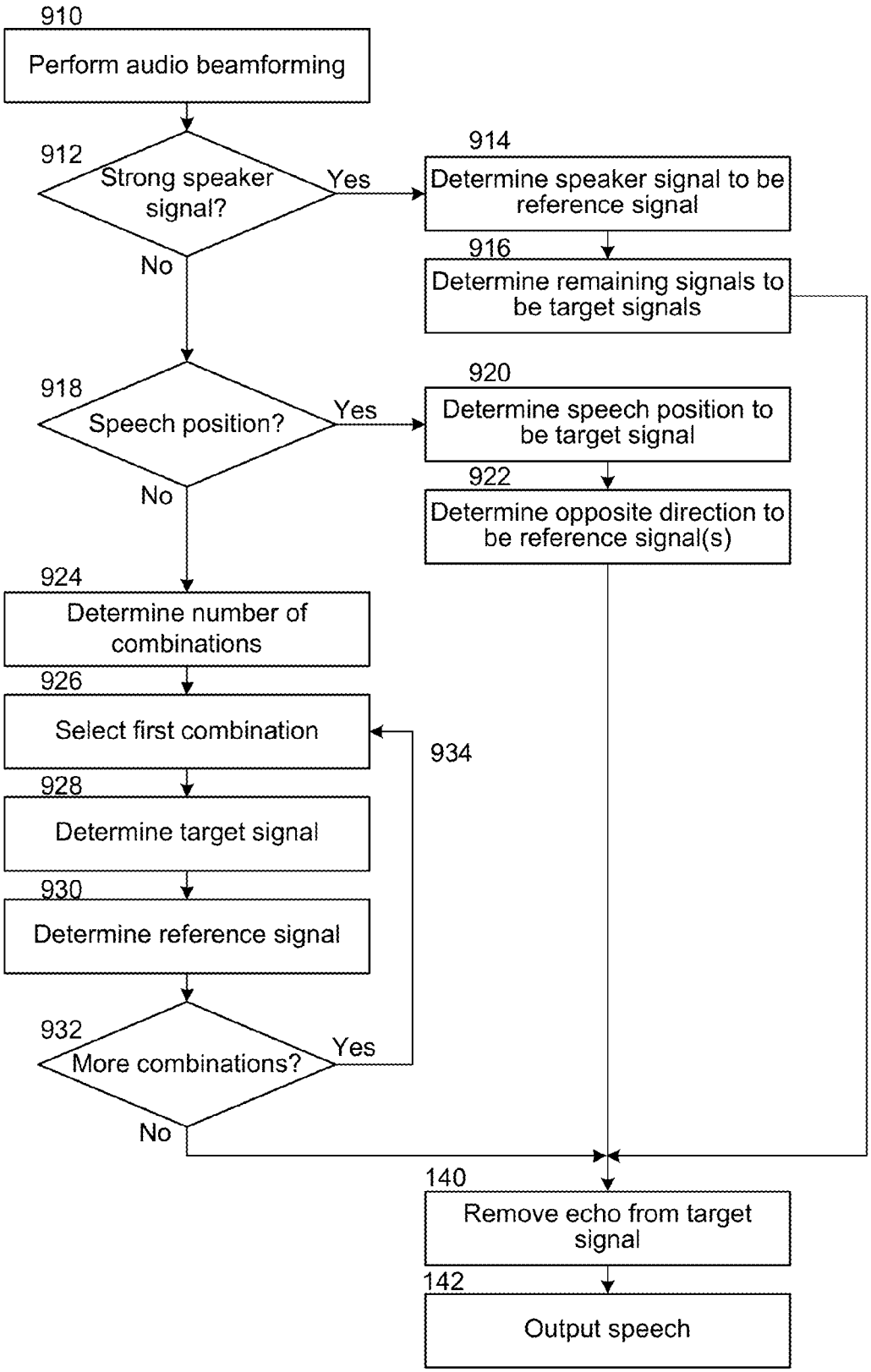
FIG. 9 is a flowchart conceptually illustrating an example method for determining a signal mapping according to embodiments of the present disclosure.

FIG. 9 is a flowchart conceptually illustrating an example method for determining a signal mapping according to embodiments of the present disclosure. As illustrated in FIG. 9, the device 102 may perform (910) audio beamforming to separate audio data into multiple sections. The device 102 may determine (912) if there is a strong speaker signal in one or more of the sections. If there is a strong speaker signal, the device 102 may determine (914) the speaker signal (e.g., section associated with the speaker signal) to be a reference signal and may determine (916) remaining signals to be target signals. The device 102 may then remove (140) an echo from the target signal using the reference signal and may output (142) speech, as discussed above with regard to FIG. 1.

While not illustrated in FIG. 9, if the device 102 detects two or more strong speaker signals, the device 102 may determine one or more reference signals corresponding to the two or more strong speaker signals and may determine one or more target signals corresponding to the remaining portions of the audio beamforming, As discussed above, the device 102 may determine any combination of target signals, reference signals and output signals without departing from the disclosure. For example, as discussed above with regard to FIG. 6B, the device 102 may determine reference signals associated with the wireless speakers and may select remaining portions of the beamforming output as target signals. Additionally or alternatively, as illustrated in FIG. 6C, if the device 102 detects multiple wireless speakers then the device 102 may generate separate reference signals, with each wireless speaker associated with a reference signal and sections opposite the reference signals associated with corresponding target signals. For example, the device 102 may detect a first wireless speaker, determine a corresponding section to be a first reference signal, determine one or more sections opposite the first reference signal and determine the one or more sections to be first target signals. Then the device 102 may detect a second wireless speaker, determine a corresponding section to be a second reference signal, determine one or more sections opposite the second reference signal and determine the one or more sections to be second target signals.

If the device 102 does not detect a strong speaker signal, the device 102 may determine (918) if there is a speech position in the audio data or associated with the audio data. For example, the device 102 may identify a person speaking and/or a position associated with the person using audio data (e.g., audio beamforming), associated video data (e.g., facial recognition) and/or other inputs known to one of skill in the art. In some examples, the device 102 may determine that speech is associated with a section and may determine a speech position using the section. In other examples, the device 102 may receive video data associated with the audio data and may use facial recognition or other techniques to determine a position associated with a face recognized in the video data. If the device 102 detects a speech position, the device 102 may determine (920) the speech position to be a target signal and may determine (922) an opposite direction to be reference signal(s). For example, a first section S1 may be associated with the target signal and the device 102 may determine that a fifth section S5 is opposite the first section S1 and may use the fifth section S5 as the reference signal. The device 102 may determine more than one section to be reference signals without departing from the disclosure. The device 102 may then remove (140) an echo from the target signal using the reference signal(s) and may output (142) speech, as discussed above with regard to FIG. 1. While not illustrated in FIG. 9, the device 102 may determine two or more speech positions (e.g., near end talk positions) and may determine one or more target signals based on the two or more speech positions. For example, the device 102 may select multiple sections of the audio beamforming corresponding to the two or more speech positions as a single target signal, or the device 102 may select first sections of the audio beamforming corresponding to a first speech position as a first target signal and may select second sections of the audio beamforming corresponding to a second speech position as a second target signal.

If the device 102 does not detect a speech position, the device 102 may determine (924) a number of combinations based on the audio beamforming. For example, the device 102 may determine a number of combinations of opposing sections and/or microphones, as illustrated in FIGS. 8A-8B. The device 102 may selet (926) a first combination, determine (828) a target signal and determine (930) a reference signal. For example, the device 102 may select a first section S1 as a target signal and select a fifth section S5, opposite the first section S1, as a reference signal. The device 102 may determine (932) if there are additional combinations and if so, may loop (934) to step 926 and repeat steps 926-930. For example, in a later combination the device 102 may select the fifth section S5 as a target signal and the first section S1 as a reference signal. Once the device 102 has determined a target signal and a reference signal for each combination, the device 102 may remove (140) an echo from the target signals using the reference signals and output (142) speech, as discussed above with regard to FIG. 1.

Figure 10A:
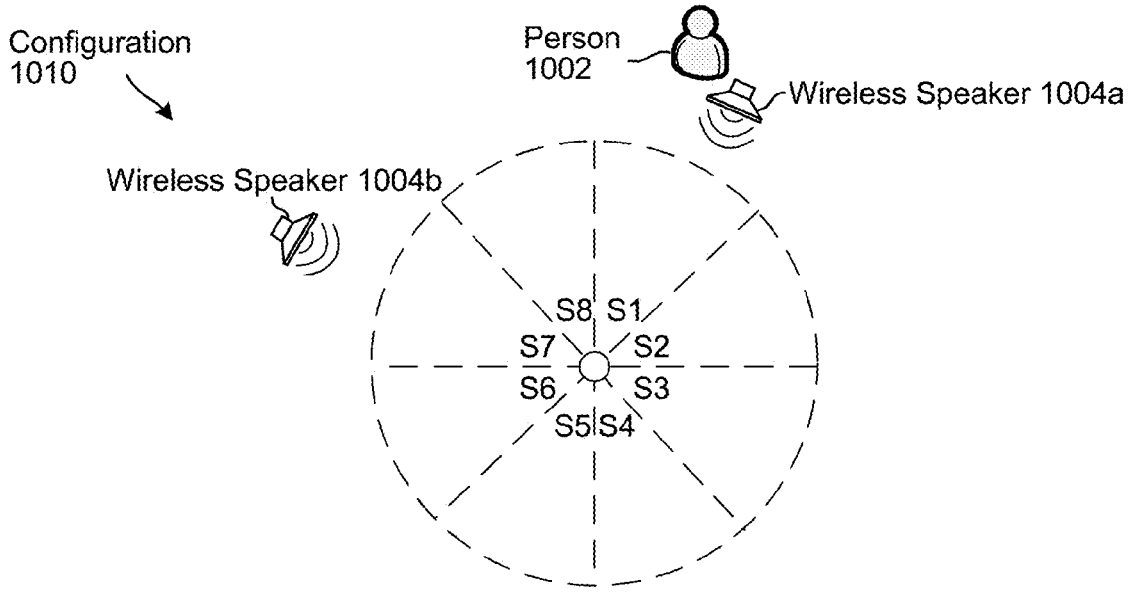
FIGS. 10A-10B illustrate an example of a signal mapping using a fourth technique according to embodiments of the present disclosure.
Figure 10B:
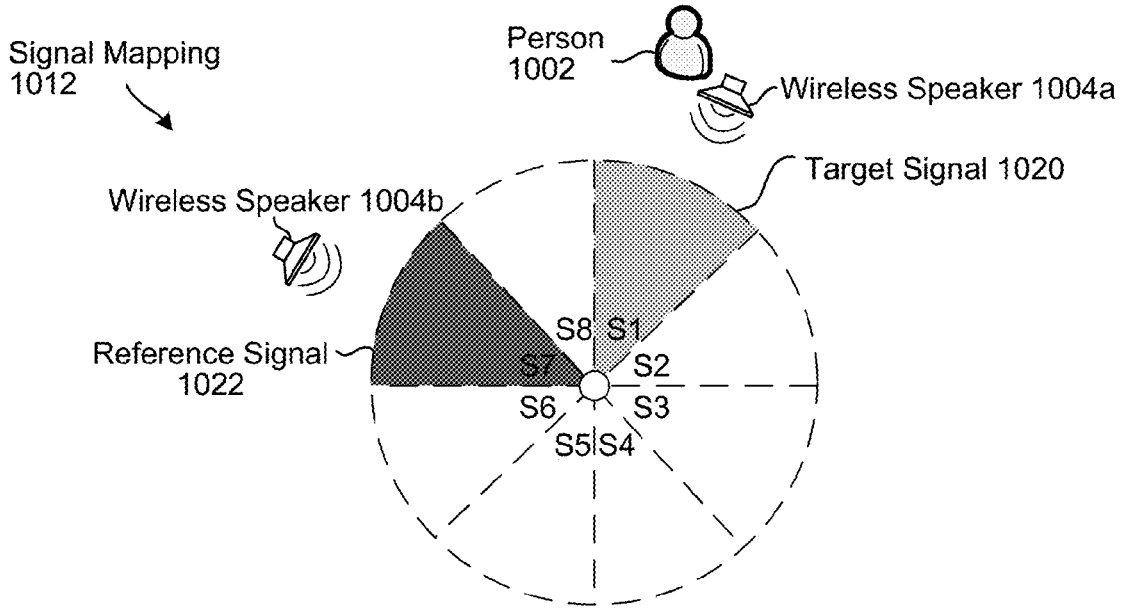

In some examples, the speech position may be in proximity to a wireless speaker (e.g., a distance between the speech position and the wireless speaker is below a threshold). Therefore, the device 102 may group speech generated by a person with audio output by the wireless speaker, removing both the echo (e.g., audio output by the wireless speaker) and the speech from the audio data. If the device 102 detects more than one wireless speaker, the device 102 may perform a fourth technique to remove the echo while retaining the speech. FIGS. 10A-10B illustrate an example of a fourth signal mapping using a fourth technique according to embodiments of the present disclosure. In the example illustrated in FIGS. 10A-10B, the device 102 has determined that there are at least two wireless speakers. In some examples, the device 102 may determine that the speech position corresponds to one of the wireless speakers, although the disclosure is not limited thereto. While FIGS. 10A-10B illustrate two wireless speakers, the technique may be applicable to three or more wireless speakers without departing from the present disclosure.

As illustrated in FIG. 10A, a configuration 1010 may include a first wireless speaker 1004*a* and a second wireless speaker 1004*b*. At some time, a person 1002 may be positioned in proximity to the first wireless speaker 1004*a*, which may result in the device 102 grouping speech from the person 1002 with audio output from the first wireless speaker 1004*a* and removing the speech from the audio data in addition to the audio output by the first wireless speaker 1004*a*. To prevent this unintended removal of speech, the device 102 may optionally determine that the person 1002 is in proximity to the first wireless speaker 1004*a* (e.g., the person 1002 and the wireless speaker 1004*a* are both associated with first section S1) and may select the first section S1 as a target signal 1020. The device 102 may then select seventh section S7, associated with the second wireless speaker 1004*b*, as a reference signal 1022. The device 102 may remove the reference signal 1022 from the target signal 1020, isolating speech generated by the person 1002 from audio output by the first wireless speaker 1004*a*.

In some examples, the device 102 may use techniques known to one of skill in the art to match first audio output by the first wireless speaker 1004*a* to second audio output by the second wireless speaker 1004*b*. For example, the device 102 may determine a propagation delay between the first audio output and the second audio output and may remove the reference signal 1022 from the target signal 1020 based on the propagation delay.

Figure 11:
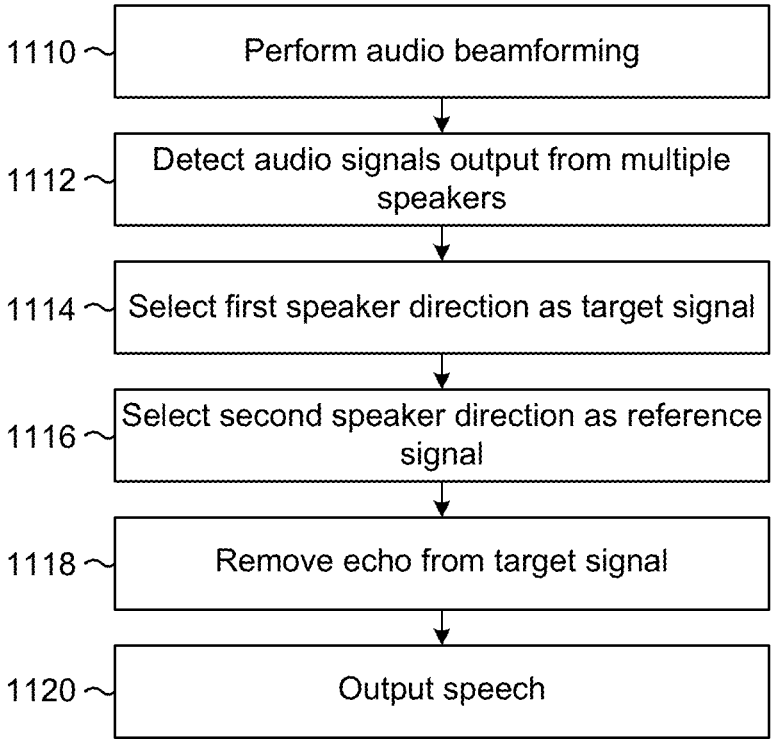
FIG. 11 is a flowchart conceptually illustrating an example method for determining a signal mapping according to embodiments of the present disclosure.

FIG. 11 is a flowchart conceptually illustrating an example method for determining a signal mapping according to embodiments of the present disclosure. As illustrated in FIG. 11, the device 102 may perform (1110) audio beamforming to separate audio data into separate sections. The device 102 may detect (1112) audio signals output from multiple wireless speakers. For example, the device 102 may identify a first wireless speaker associated with a first speaker direction and identify a second wireless speaker with a second speaker direction. The device 102 may select (1114) the first speaker direction as a target signal and may select (1116) the second speaker direction as a reference signal. The device 102 may remove (1118) an echo from the target signal using the reference signal to isolate speech and may output (1120) the speech. For example, a speech position of the speech may be in proximity to the first wireless speaker and the device 102 may remove the second audio output by the second wireless speaker from the first audio output by the first wireless speaker to isolate the speech. In some examples, the device 102 may determine the speech position and may select the target signal based on the speech position (e.g., the speech position is associated with the target signal). However, the disclosure is not limited thereto and the device 102 may isolate the speech even when the speech is associated with the reference signal.

Figure 12:
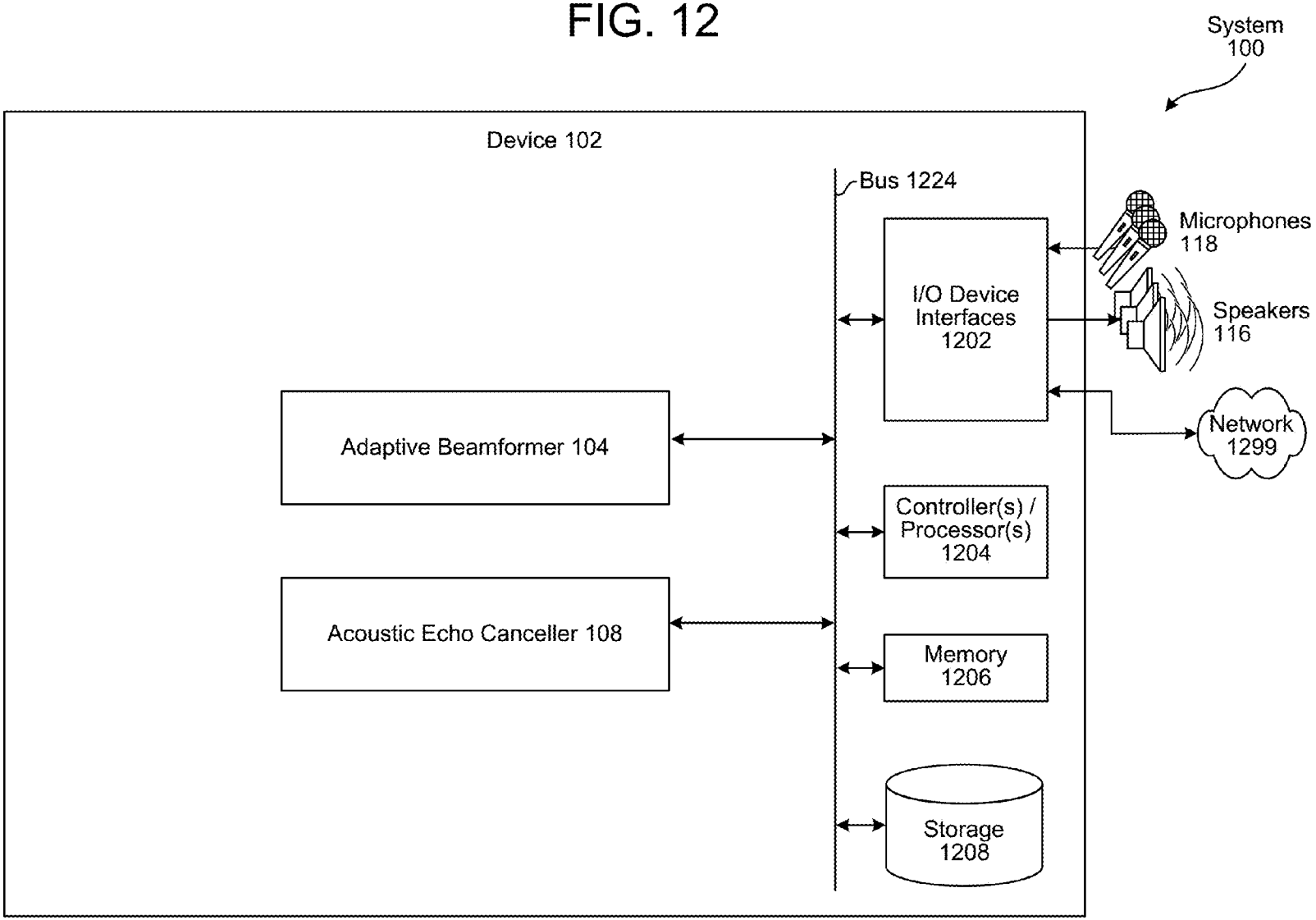
FIG. 12 is a block diagram conceptually illustrating example components of a system for echo cancellation according to embodiments of the present disclosure.

FIG. 12 is a block diagram conceptually illustrating example components of the system 100. In operation, the system 100 may include computer-readable and computer-executable instructions that reside on the device 102, as will be discussed further below.

The system 100 may include one or more audio capture device(s), such as a microphone or an array of microphones 118. The audio capture device(s) may be integrated into the device 102 or may be separate.

The system 100 may also include an audio output device for producing sound, such as speaker(s) 116. The audio output device may be integrated into the device 102 or may be separate.

The device 102 may include an address/data bus 1224 for conveying data among components of the device 102. Each component within the device 102 may also be directly connected to other components in addition to (or instead of) being connected to other components across the bus 1224.

The device 102 may include one or more controllers/processors 1204, that may each include a central processing unit (CPU) for processing data and computer-readable instructions, and a memory 1206 for storing data and instructions. The memory 1206 may include volatile random access memory (RAM), non-volatile read only memory (ROM), non-volatile magnetoresistive (MRAM) and/or other types of memory. The device 102 may also include a data storage component 1208, for storing data and controller/processor-executable instructions (e.g., instructions to perform the algorithms illustrated in FIGS. 1, 10 and/or 11). The data storage component 1208 may include one or more non-volatile storage types such as magnetic storage, optical storage, solid-state storage, etc. The device 102 may also be connected to removable or external non-volatile memory and/or storage (such as a removable memory card, memory key drive, networked storage, etc.) through the input/output device interfaces 1202.

Computer instructions for operating the device 102 and its various components may be executed by the controller(s)/processor(s) 1204, using the memory 1206 as temporary "working" storage at runtime. The computer instructions may be stored in a non-transitory manner in non-volatile memory 1206, storage 1208, or an external device. Alternatively, some or all of the executable instructions may be embedded in hardware or firmware in addition to or instead of software.

The device 102 includes input/output device interfaces 1202. A variety of components may be connected through the input/output device interfaces 1202, such as the speaker(s) 116, the microphones 118, and a media source such as a digital media player (not illustrated). The input/output interfaces 1202 may include A/D converters for converting the output of microphone 118 into signals y 120, if the microphones 118 are integrated with or hardwired directly to device 102. If the microphones 118 are independent, the A/D converters will be included with the microphones, and may be clocked independent of the clocking of the device 102. Likewise, the input/output interfaces 1202 may include D/A converters for converting the reference signals x 112 into an analog current to drive the speakers 114, if the speakers 114 are integrated with or hardwired to the device 102. However, if the speakers are independent, the D/A converters will be included with the speakers, and may be clocked independent of the clocking of the device 102 (e.g., conventional Bluetooth speakers).

The input/output device interfaces 1202 may also include an interface for an external peripheral device connection such as universal serial bus (USB), FireWire, Thunderbolt or other connection protocol. The input/output device interfaces 1202 may also include a connection to one or more networks 1299 via an Ethernet port, a wireless local area network (WLAN) (such as WiFi) radio, Bluetooth, and/or wireless network radio, such as a radio capable of communication with a wireless communication network such as a Long Term Evolution (LTE) network, WiMAX network, 3G network, etc. Through the network 1299, the system 100 may be distributed across a networked environment.

The device 102 further includes an adaptive beamformer 104, which includes a fixed beamformer (FBF) 105, a multiple input canceler (MC) 106 and a blocking matrix (BM) 107, and an acoustic echo cancellation (AEC) 108.

Multiple devices 102 may be employed in a single system 100. In such a multi-device system, each of the devices 102 may include different components for performing different aspects of the AEC process. The multiple devices may include overlapping components. The components of device 102 as illustrated in FIG. 12 is exemplary, and may be a stand-alone device or may be included, in whole or in part, as a component of a larger device or system. For example, in certain system configurations, one device may transmit and receive the audio data, another device may perform AEC, and yet another device my use the audio output 126 for operations such as speech recognition.

The concepts disclosed herein may be applied within a number of different devices and computer systems, including, for example, general-purpose computing systems, multimedia set-top boxes, televisions, stereos, radios, server-client computing systems, telephone computing systems, laptop computers, cellular phones, personal digital assistants (PDAs), tablet computers, wearable computing devices (watches, glasses, etc.), other mobile devices, etc.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. Persons having ordinary skill in the field of digital signal processing and echo cancellation should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Aspects of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk and/or other media. Some or all of the STFT AEC module 1230 may be implemented by a digital signal processor (DSP).

As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method for cancelling an echo from an audio signal to isolate received speech, the method comprising:

sending a first output audio signal to a first wireless speaker;

receiving a first input audio signal from a first microphone of a microphone array, the first input audio signal including a first representation of audible sound output by the first wireless speaker and a first representation of speech input;

receiving a second input audio signal from a second microphone of the microphone array, the second input audio signal including a second representation of the audible sound output by the first wireless speaker and a second representation of the speech input;

performing first audio beamforming to determine a first portion of combined input audio data comprising a first portion of the first input audio signal corresponding to a first direction and a first portion of the second input audio signal corresponding to the first direction;

performing second audio beamforming to determine a second portion of the combined input audio data comprising a second portion of the first input audio signal corresponding to a second direction and a second portion of the second input audio signal corresponding to the second direction;

selecting at least the first portion as a target signal on which to perform echo cancellation;

selecting at least the second portion as a reference signal to remove from the target signal;

removing the reference signal from the target signal to generate a second output audio signal including a third representation of the speech input;

performing speech recognition processing on the second output audio signal to determine a command; and executing the command.

2. The computer-implemented method of claim 1, further comprising:

determining that the second portion corresponds to a highest amplitude representation of the audible sound output of a plurality of portions;

determining that an amplitude of the second portion is above a threshold;

associating the second portion with the first wireless speaker;

selecting the second portion as the reference signal; and selecting remaining portions of the plurality of portions as the target signal.

3. The computer-implemented method of claim 1, further comprising:

determining that the speech input is associated with the first direction;

selecting the first portion as the target signal; and selecting at least the second portion as the reference signal.

4. The computer-implemented method of claim 1, further comprising:

determining that the second portion corresponds to a highest amplitude representation of the audible sound output of a plurality of portions;

determining that an amplitude of the second portion is below a threshold;

selecting the first portion as the target signal;

determining that the second direction is opposite the first direction;

selecting the second portion as the reference signal;

selecting the second portion as a second target signal;

selecting the first portion as a second reference signal;

removing the reference signal from the target signal to generate the second output audio signal; and removing the second reference signal from the second target signal to generate a third output audio signal.

5. A computer-implemented method, comprising:

receiving first input audio data from a first microphone of a microphone array, the first input audio data including a first representation of sound output by a first wireless speaker and a first representation of speech input;

receiving second input audio data from a second microphone of the microphone array, the second input audio data including a second representation of the audible sound output by the first wireless speaker and a second representation of the speech input;

performing first audio beamforming to determine a first portion of combined input audio data comprising a first portion of the first input audio signal corresponding to a first direction and a first portion of the second input audio signal corresponding to the first direction;

performing second audio beamforming to determine a second portion of the combined input audio data comprising a second portion of the first input audio signal corresponding to a second direction and a second portion of the second input audio signal corresponding to the second direction;

selecting at least the first portion as a target signal;

selecting at least the second portion as a reference signal; and removing the reference signal from the target signal to generate first output audio data including a third representation of the speech input.

6. The computer-implemented method of claim 5, further comprising:

sending second output audio data to the first wireless speaker;

determining that the second portion corresponds to a highest amplitude of a plurality of portions;

determining that an amplitude of the second portion is above a threshold; and associating the second portion with the first wireless speaker.

7. The computer-implemented method of claim 5, further comprising:

determining that an amplitude associated with the second portion is above a threshold;

determining that a highest amplitude associated with remaining portions of a plurality of portions is below the threshold;

selecting the second portion as the reference signal; and selecting the remaining portions as the target signal.

8. The computer-implemented method of claim 5, further comprising:

determining that a first amplitude associated with the second portion is above a threshold;

determining that a second amplitude associated with a third portion of a plurality of portions is above the threshold;

selecting the second portion as the reference signal;

selecting the third portion as a second reference signal;

selecting at least the first portion as the target signal; and removing the reference signal and the second reference signal from the target signal to generate the first output audio data.

9. The computer-implemented method of claim 5, further comprising:

determining that a first amplitude associated with the first portion is above a threshold;

determining that a second amplitude associated with the second portion is above the threshold;

determining that the speech input is associated with the first direction;

selecting the first portion as the target signal; and selecting the second portion as the reference signal.

10. The computer-implemented method of claim 5, further comprising:

determining that the speech input is associated with the first direction selecting the first portion as the target signal;

determining that the second direction is opposite the first direction; and selecting at least the second portion as the reference signal.

11. The computer-implemented method of claim 5, further comprising:

determining that the second portion corresponds to a highest amplitude of a plurality of portions;

determining that an amplitude of the second portion is below a threshold;

selecting the first portion as the target signal;

determining that the second direction is opposite the first direction;

selecting the second portion as the reference signal;

selecting the second portion as a second target signal;

selecting the first portion as a second reference signal; and removing the second reference signal from the second target signal to generate second output audio data including a fourth representation of the speech input.

12. The computer-implemented method of claim 5, further comprising:

performing the first audio beamforming to determine the first portion using a fixed beamforming technique;

performing the second audio beamforming to determine the second portion using the fixed beamforming technique;

determining that a first amplitude associated with the first portion is below a threshold;

determining that a second amplitude associated with the second portion is above the threshold;

performing, using an adaptive beamforming technique, third audio beamforming to determine a third portion of the combined input audio data comprising a third portion of the first input audio signal corresponding to the second direction and a third portion of the second input audio signal corresponding to the second direction;

selecting at least the first portion as the target signal; and selecting at least the third portion as the reference signal.

13. A device, comprising:

at least one processor;

a memory device including instructions operable to be executed by the at least one processor to configure the device to:

receive first input audio data from a first microphone of a microphone array, the first input audio data including a first representation of sound output by a first wireless speaker and a first representation of speech input;

receive second input audio data from a second microphone of the microphone array, the second input audio data including a second representation of the audible sound output by the first wireless speaker and a second representation of the speech input;

perform first audio beamforming to determine a first portion of combined input audio data comprising a first portion of the first input audio signal corresponding to a first direction and a first portion of the second input audio signal corresponding to the first direction;

perform second audio beamforming to determine a second portion of the combined input audio data comprising a second portion of the first input audio signal corresponding to a second direction and a second portion of the second input audio signal corresponding to the second direction;

select at least the first portion as a target signal;

select at least the second portion as a reference signal; and remove the reference signal from the target signal to generate first output audio data including a third representation of the speech input.

14. The system of claim 13, wherein the instructions further configure the system to:

sending second output audio data to the first wireless speaker;

determine that the second portion corresponds to a highest amplitude of a plurality of portions;

determine that an amplitude of the second portion is above a threshold; and associate the second portion with the first wireless speaker.

15. The system of claim 13, wherein the instructions further configure the system to:

determine that an amplitude associated with the second portion is above a threshold;

determine that a highest amplitude associated with remaining portions of a plurality of portions is below the threshold;

select the second portion as the reference signal; and select the remaining portions as the target signal.

16. The system of claim 13, wherein the instructions further configure the system to:

determine that a first amplitude associated with the second portion is above a threshold;

determine that a second amplitude associated with a third portion of a plurality of portions is above the threshold;

select the second portion as the reference signal;

select the third portion as a second reference signal;

select at least the first portion as the target signal; and remove the reference signal and the second reference signal from the target signal to generate the first output audio data.

17. The system of claim 13, wherein the instructions further configure the system to:

determine that a first amplitude associated with the first portion is above a threshold;

determine that a second amplitude associated with the second portion is above the threshold;

determine that the speech input is associated with the first direction;

select the first portion as the target signal; and select the second portion as the reference signal.

18. The system of claim 13, wherein the instructions further configure the system to:

determine that the speech input is associated with the first direction select the first portion as the target signal;

determine that the second direction is opposite the first direction; and select at least the second portion as the reference signal.

19. The system of claim 13, wherein the instructions further configure the system to:

determine that the second portion corresponds to a highest amplitude of a plurality of portions;

determine that an amplitude of the second portion is below a threshold;

select the first portion as the target signal;

determine that the second direction is opposite the first direction;

select the second portion as the reference signal;

select the second portion as a second target signal;

select the first portion as a second reference signal; and remove the second reference signal from the second target signal to generate second output audio data including a fourth representation of the speech input.

20. The system of claim 13, wherein the instructions further configure the system to:

perform the first audio beamforming to determine the first portion using a fixed beamforming technique;

perform the second audio beamforming to determine the second portion using the fixed beamforming technique;

determine that a first amplitude associated with the first portion is below a threshold;

determine that a second amplitude associated with the second portion is above the threshold;

perform, using an adaptive beamforming technique, third audio beamforming to determine a third portion of the combined input audio data comprising a third portion of the first input audio signal corresponding to the second direction and a third portion of the second input audio signal corresponding to the second direction;

select at least the first portion as the target signal; and select at least the third portion as the reference signal.

* * * * *